US009835995B2

(12) United States Patent
Furusawa

(10) Patent No.: US 9,835,995 B2
(45) Date of Patent: Dec. 5, 2017

(54) FUSER DEVICE AND IMAGE FORMING APPARATUS

(71) Applicant: Oki Data Corporation, Tokyo (JP)

(72) Inventor: Yasunori Furusawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/238,396

(22) Filed: Aug. 16, 2016

(65) Prior Publication Data

US 2017/0060056 A1 Mar. 2, 2017

(30) Foreign Application Priority Data

Aug. 27, 2015 (JP) ..... 2015-167810

(51) Int. Cl.
*G03G 15/20* (2006.01)
*G03G 21/16* (2006.01)

(52) U.S. Cl.
CPC ..... *G03G 15/2053* (2013.01); *G03G 15/2032* (2013.01); *G03G 21/1685* (2013.01); *G03G 2215/2009* (2013.01)

(58) Field of Classification Search
CPC ..... G03G 15/2053; G03G 15/2082
See application file for complete search history.

(56) References Cited

U.S. PATENT DOCUMENTS

2005/0129431 A1* 6/2005 Oohara ..... G03G 15/2028 399/329
2007/0230983 A1* 10/2007 Nakamoto ..... G03G 15/2032 399/69
2010/0150624 A1* 6/2010 Yamamoto ..... G03G 15/2053 399/329
2011/0008085 A1* 1/2011 Okamoto ..... G03G 15/2025 399/329
2011/0064493 A1* 3/2011 Muramatsu ..... G03G 15/2064 399/329
2014/0072356 A1* 3/2014 Murakami ..... G03G 15/2085 399/329
2015/0030345 A1* 1/2015 Murakami ..... G03G 15/2039 399/69

FOREIGN PATENT DOCUMENTS

JP 2015-087624 A 5/2015

* cited by examiner

*Primary Examiner* — G. M. Hyder
(74) *Attorney, Agent, or Firm* — Muncy, Geissler, Olds & Lowe, P.C.

(57) ABSTRACT

A fuser device fusing a developer image on a medium includes a stable first unit, a movable second unit, and a movement mechanism moving the second unit between first and second positions. The first unit includes an endless first belt and a rotatably fuser member about a rotation shaft inside the first belt, the second unit includes an endless second belt, a pressure application member rotatably held about another rotation shaft displaceable inside the second belt, and a first bias member that biases the pressure application member toward the fuser member, and the pressure application member at the first position presses the fuser member such that a nip part is formed between the pressure application member and the fuser member, and at the second position, is detached from the fuser member so that the nip part is eliminated.

12 Claims, 21 Drawing Sheets

A-A

A-A

B–B

C–C

D-D

E-E

B–B

E-E

FUSER DEVICE AND IMAGE FORMING APPARATUS

CROSS REFERENCE TO RELATED APPLICATION(S)

This application claims priority under 35 USC 119 to Japanese Patent Application No. 2015-167810 filed on Aug. 27, 2015, the entire contents which are incorporated herein by reference.

TECHNICAL FIELD

The present invention relates to an image forming apparatus, and more particularly to a configuration of a fuser device thereof.

BACKGROUND

Conventionally, in a fuser device of an image forming apparatus, a developer image was fused on a print medium by applying heat and pressure to a medium in which the developer image was transferred (For example, see Patent Document 1).

RELATED ART

[Patent Doc. 1] Japanese Laid-Open Patent Application Publication 2015-87624 (Page 7, FIG. 1)

However, with the conventional configuration, there were undesirable cases in which heat was applied to a medium for a long time when the print medium was stopped inside a fuser device.

SUMMARY

A fuser device that fuses a developer image on a recording medium that is carried along a carrying path includes: a first unit that is stable to the fuser device; a second unit that is movably arranged with respect to the first unit, the carrying path intervening between the first unit and the second unit; and a movement mechanism that moves the second unit between a first position and a second position with respect to the first unit, at least one of the first unit and the second unit providing heat on the recording medium. Wherein the first unit includes an endless first belt, and a fuser member that is rotatably held about a rotation shaft positioned on an inner side of the first belt, the second unit includes an endless second belt, a pressure application member that is rotatably held about another rotation shaft displaceable on an inner side of the second belt, and a first bias member that biases the pressure application member toward the fuser member, and the pressure application member, at the first position, presses the fuser member via the first belt and the second belt using the first bias member such that a nip part, where the developer image is fused on the recording medium, is formed between the pressure application member and the fuser member, and at the second position, is detached from the fuser member so that the nip part is eliminated.

According to the present invention, since a nip part is formed by a fuser member and a pressure application member as necessary and the rollers can be detached, an inconvenient situation in which heat is applied to a recording medium for a long time can be prevented.

DETAILED DESCRIPTION OF THE EMBODIMENTS

Figure 1:
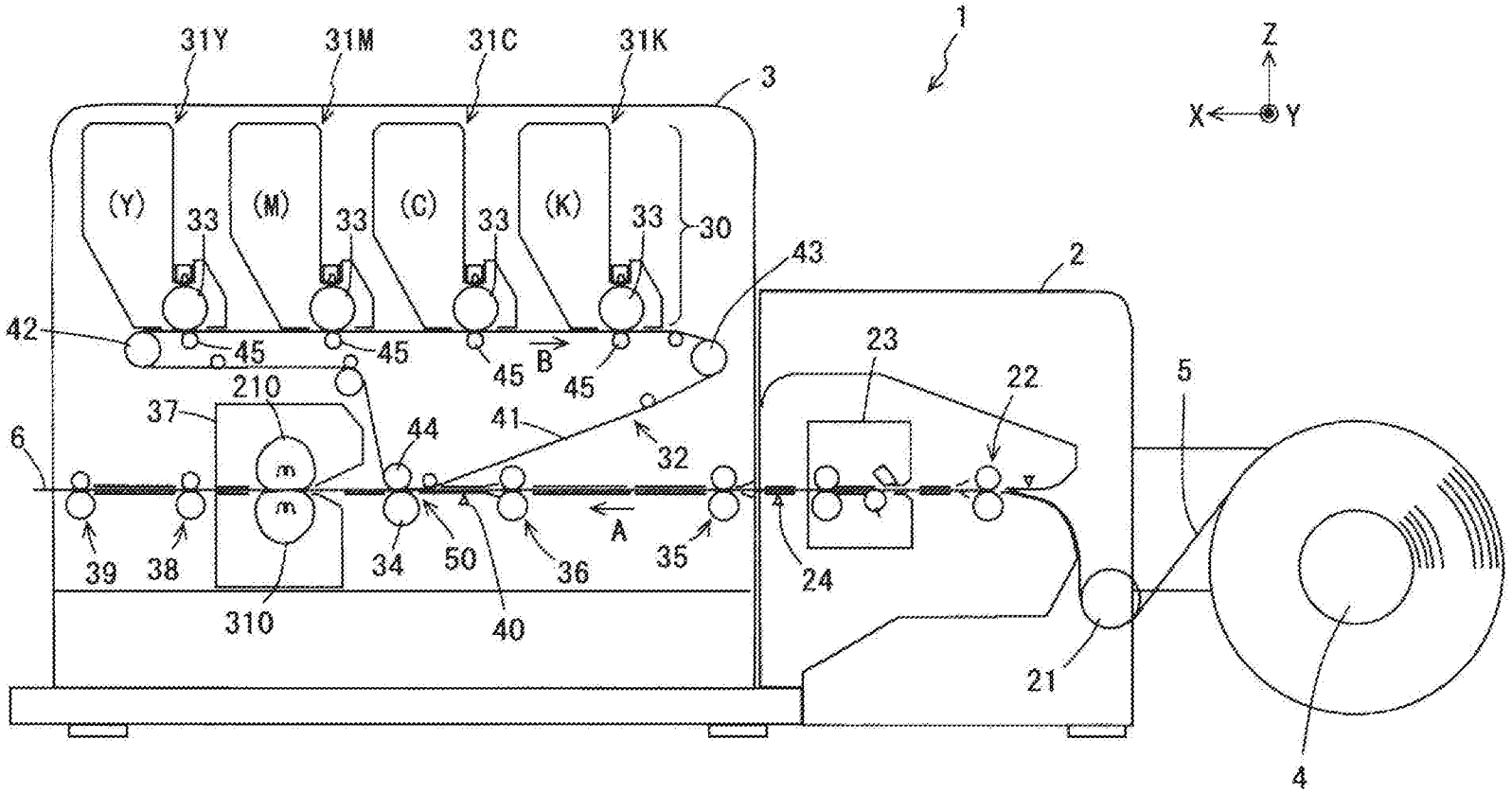
FIG. 1 is a main part configuration view showing a configuration of the main part of a printer of an example of an image forming apparatus equipped with a fuser device according to the present invention.

FIG. 1 illustrates a main part configuration of a printer of an Embodiment of an image forming apparatus equipped with a fuser device according to the present invention. The printer 1 is a color printer of an electrographic system configured to support a continuous print sheet.

As illustrated in FIG. 1, the printer 1 is equipped with a sheet holder 4 configured to hold a rolled sheet 5, an introduction guide part 2 which is an introduction part of the rolled sheet 5, and a print part 3 configured to execute printing on a recording medium.

The sheet holder 4, for example, rotatably holds the axis of the rolled sheet 5, rotates in accordance with the pulling of the leading edge side of the rolled sheet 5 toward the introduction guide part 2, and continuously supplies the rolled sheet 5 to the introduction guide part 2.

The introduction guide part 2 is equipped with a guide roller 21 for guiding the carrying of the rolled sheet 5, a feeding roller pair 22 arranged on the carrying path of the rolled sheet 5 to carry the rolled sheet 5 to the downstream side, a sheet cutting part 23 arranged on the downstream side of the feeding roller pair 22 in the carrying direction of the rolled sheet 5, and a sheet sensor 24 arranged on the downstream side of the sheet cutting part 23. The introduction guide part 2 executes carrying and cutting of the rolled sheet 5 at a predetermined timing, and detects the presence or absence of a cut rolled sheet (hereinafter referred to as a recording sheet 6) to be sent to the print part 3 by the sheet sensor 24.

On the carrying path of the recording sheet 6 in the print part 3, carrying roller pairs 35 and 36 configured to carry the recording sheet 6 to a secondary transfer part 50 from the upstream side in the arrow A direction, which is the carrying direction of the recording sheet 6, and a writing sensor 40 for obtaining the writing timing at the image forming part 30 are arranged.

The image forming part 30 of the print part 3 includes four process units 31Y, 31M, 31C, and 31K (simply referred to as 31 when there is no need to distinguish between them) each configured to form an each color toner image of yellow (Y), magenta (M), cyan (C), and black (K), and they are arranged in order from the upstream side along the arrow B direction showing the moving direction in which the intermediate transfer belt 41 of a later explained intermediate transfer belt unit 32 moves at the upper part of the intermediate transfer belt unit 32.

The intermediate transfer belt unit 32 of the print part 3 is equipped with a drive roller 42 driven by an unillustrated driving part, a tension roller 43 configured to apply tension to the intermediate transfer belt 41 with a biasing method such as a coil spring, a secondary transfer backup roller 44 arranged so as to face the secondary transfer roller 34 and constituting the secondary transfer part 50, and an intermediate transfer belt 41 stretched over the rollers, and further includes four primary transfer rollers 45, etc., arranged so as to face the photosensitive drum 33 of each of the process units 31 and configured to apply a predetermined voltage for sequentially superimposing a toner image of each color formed on the photosensitive drums 33 to transfer it onto the intermediate transfer belt 41.

The intermediate transfer belt unit 32, as described above, sequentially superimposes and primarily transfers the toner image in each color formed by an image forming part 10 onto the intermediate transfer belt 41 and carries the primarily transferred toner images to the secondary transfer part 50. At the secondary transfer part 50, the toner image primarily transferred to the intermediate transfer belt 41 is transferred to a recording sheet 6 supplied and carried from the introduction guide part 2 by the secondary transfer roller 34 in which a predetermined voltage is applied. Therefore, the skew of the recording sheet 6 is corrected while passing through the carrying roller pairs 35 and 36, and the writing sensor 40, and the carrying timing is measured.

The fuser device 37 of the print part 3 is equipped with a fuser unit 210 and a pressure application unit 310 inside and is configured to apply heat and pressure to a toner image on the recording sheet 6 sent from the secondary transfer part 50 to melt and fuse it to the recording sheet 6. After that, the recording sheet 6 is carried by the ejection roller pairs 38 and 39 and ejected outside the apparatus. Further, the fuser device 37 will be described in detailed later. Furthermore, here, the intermediate transfer belt unit 32 and the secondary transfer part 50 correspond to the image transfer part.

In FIG. 1, regarding the X, Y, and Z axes, the carrying direction (arrow A direction) when the recording sheet 6 passes the secondary transfer part 50 and the fuser device 37 is defined as an X axis, the rotation shaft direction of the carrying roller pairs 35 and 36 is defined as a Y axis, and the direction orthogonal to both axes is defined as a Z axis. Further, when the X, Y, and Z axes are shown in later explained other figures, the directions of these axes denote the same directions. In other words, in each of the figures, the X, Y, Z axes denote the arrangement direction when constituting the printer 1 as shown in FIG. 1. Here, it is assumed that the Z axis is arranged in an approximately vertical direction.

Figure 2:
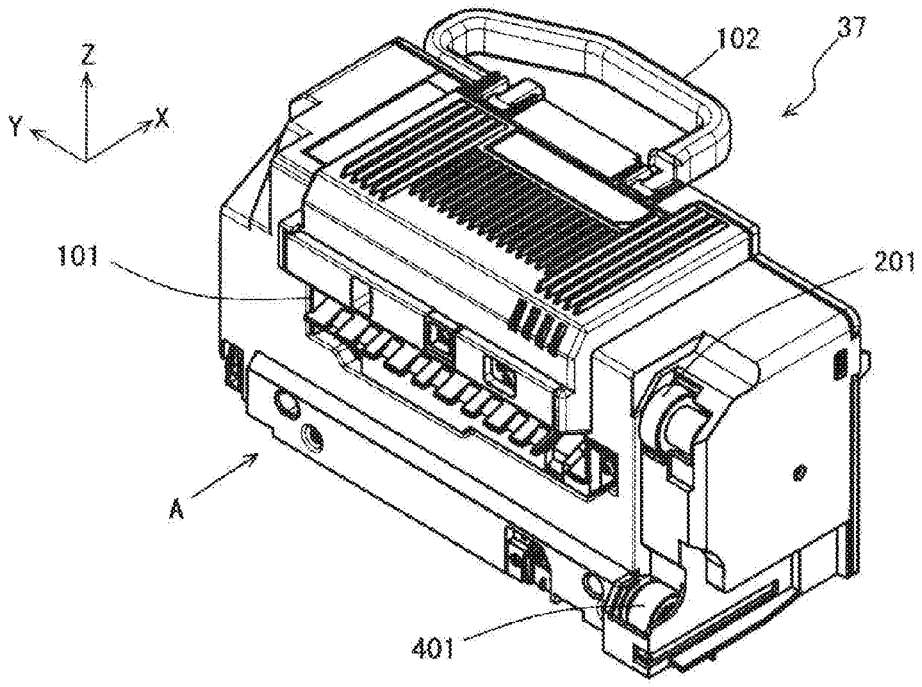
FIG. 2 is an external perspective view of a fuser device.
Figure 3:
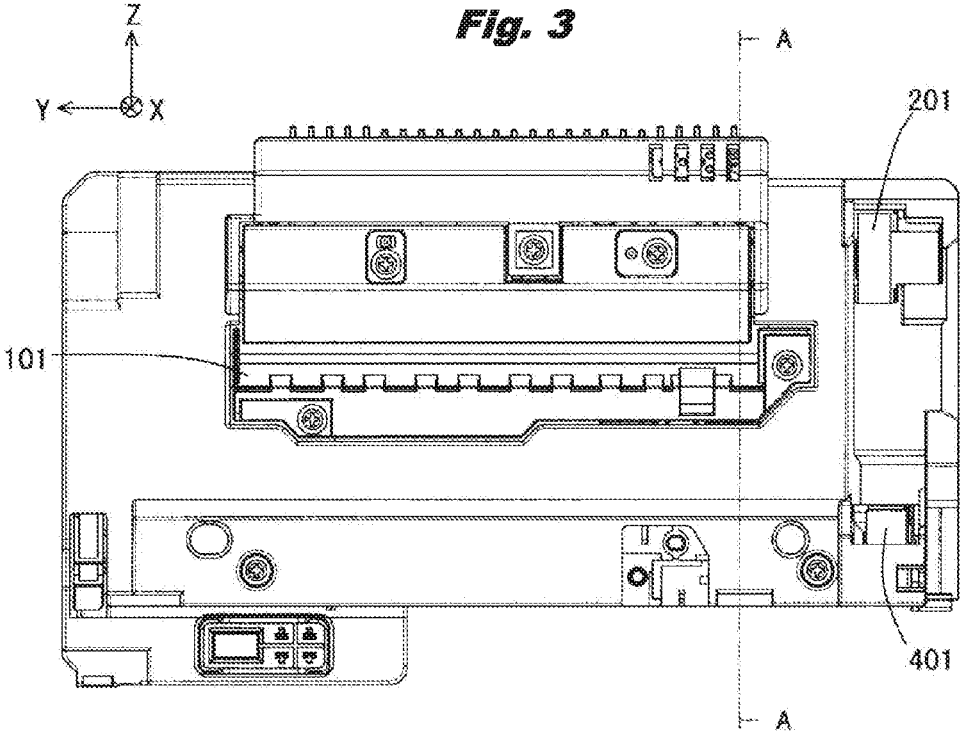
FIG. 3 is a front view of the fuser device as viewed from the upstream side of the sheet carrying direction (arrow A direction).
Figure 4:
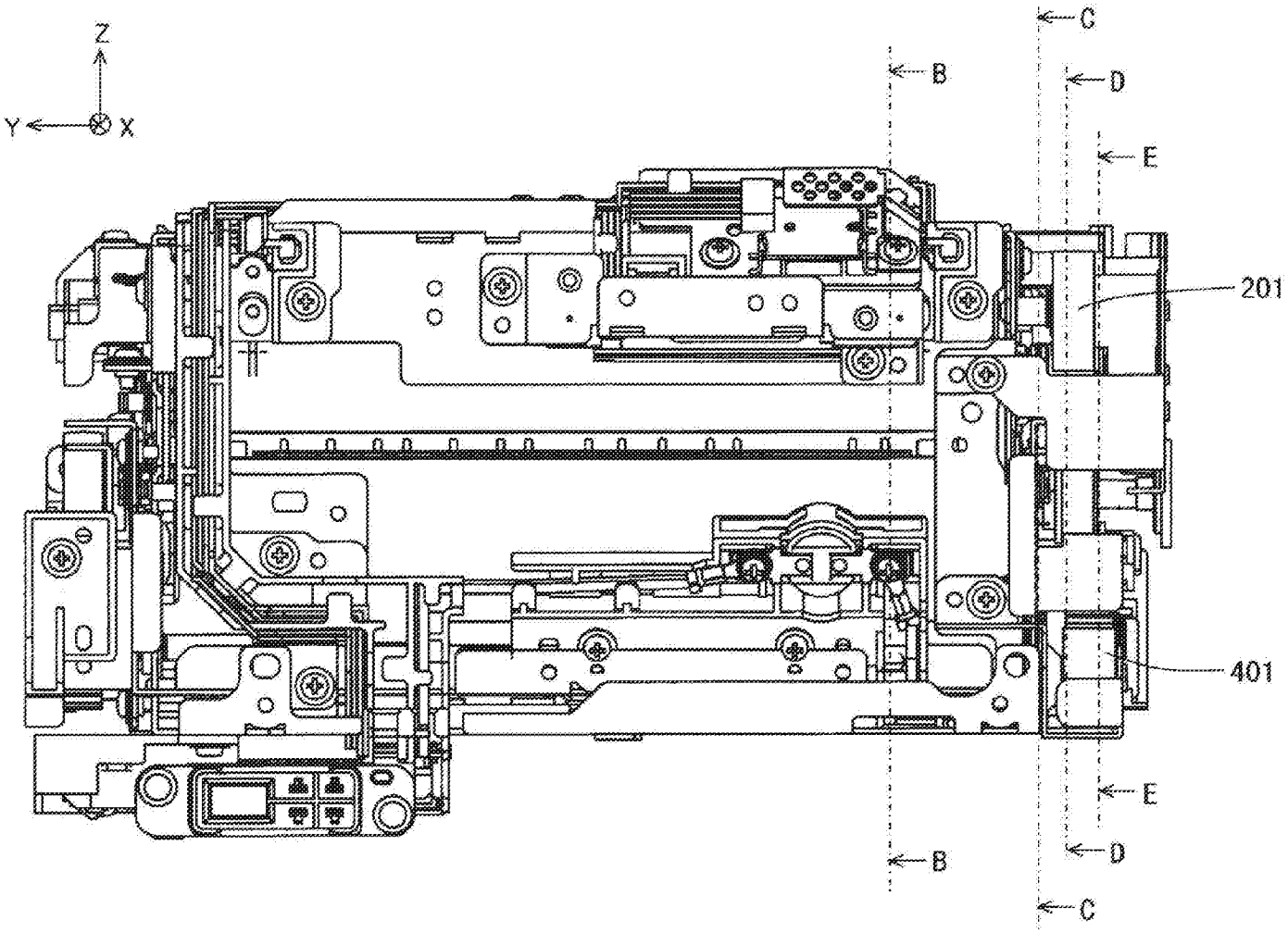
FIG. 4 is a front view showing a fuser device in which the external cover is removed.
Figure 5:
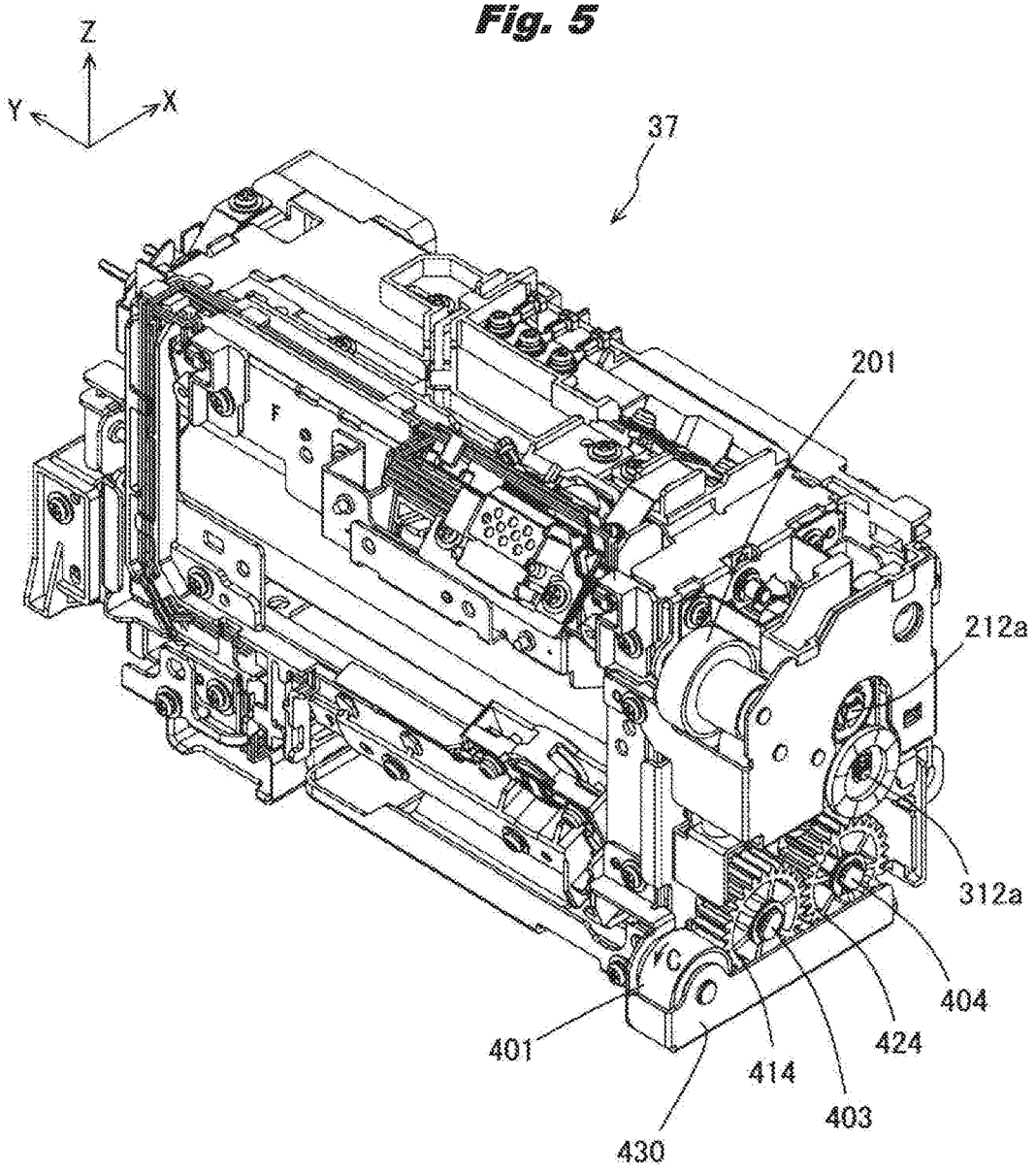
FIG. 5 is an external perspective view of the fuser device in which the external cover is removed.
Figure 6:
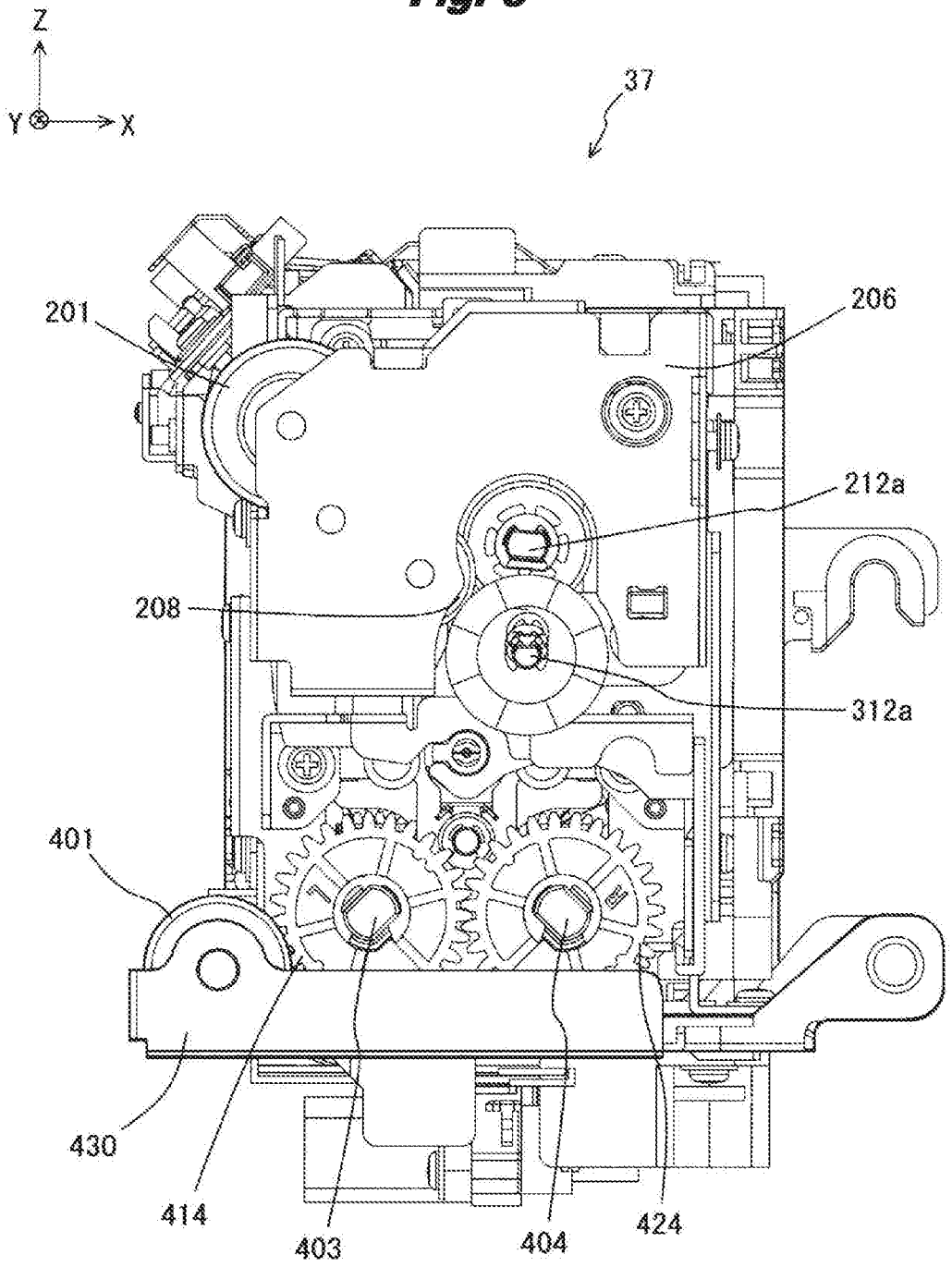
FIG. 6 is a right side view showing the fuser device in which the external cover is removed.
Figure 7:
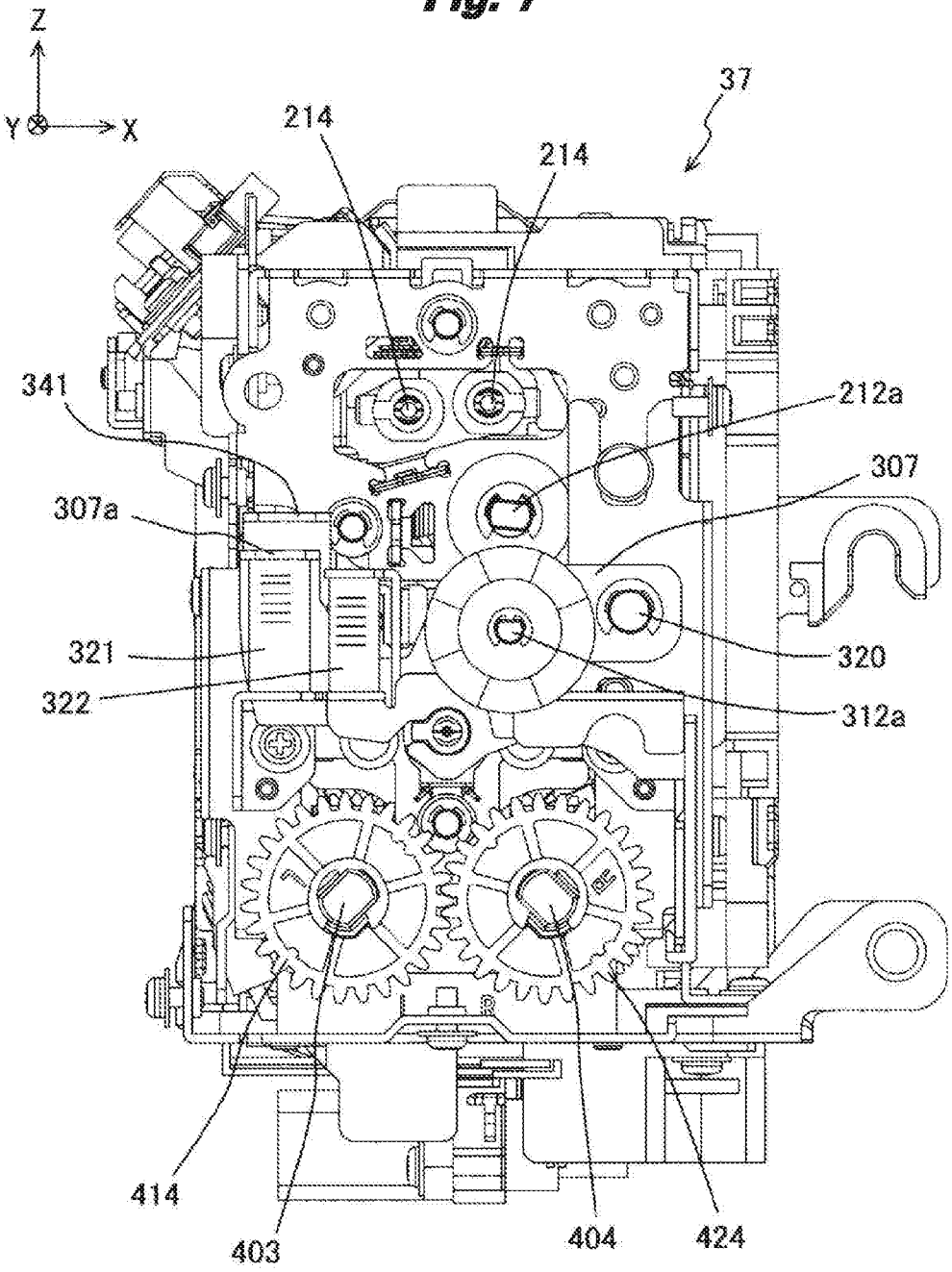
FIG. 7 is a right side view showing a state in which a drive transmission system is removed.
Figure 8:
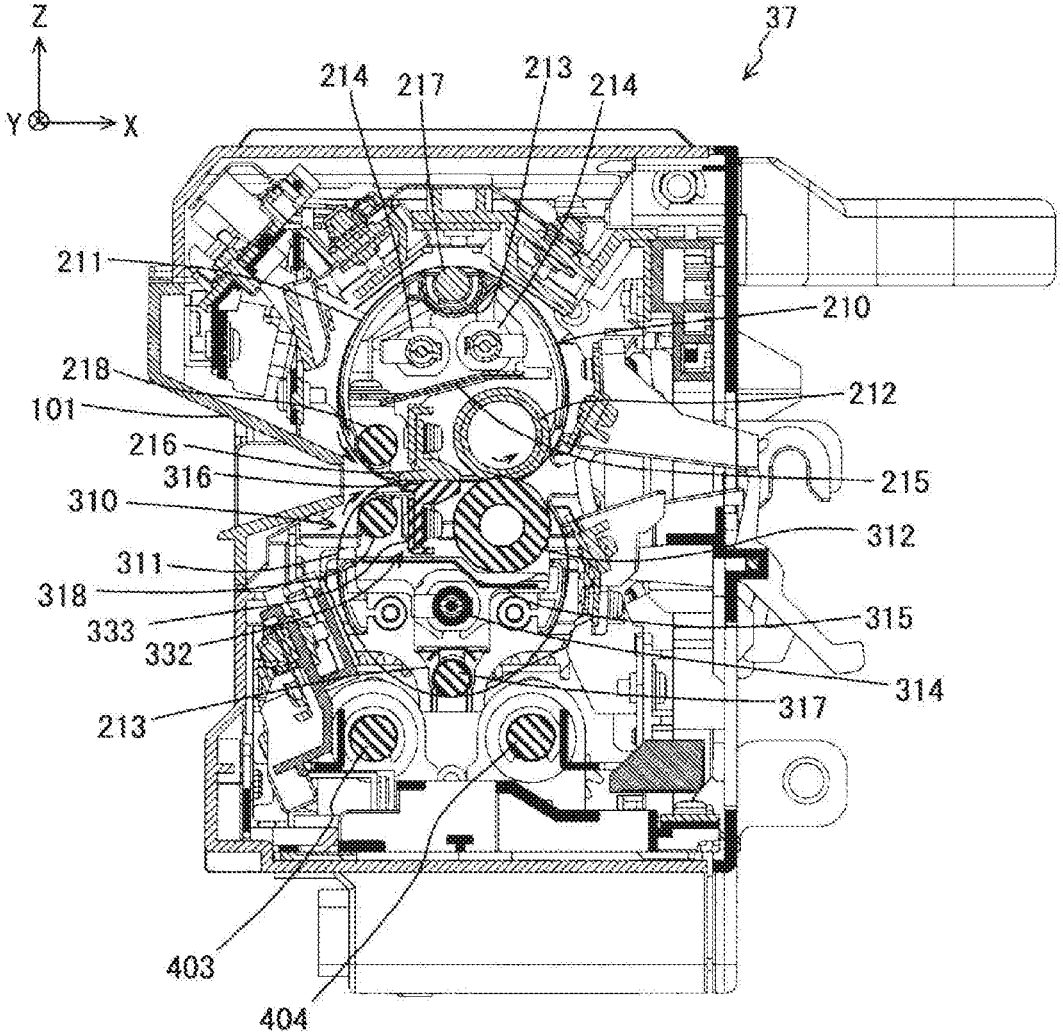
FIG. 8 is a view showing the A-A cross-section of FIG. 3 as viewed from the arrow direction.

FIG. 2 is an external perspective view of the fuser device 37, FIG. 3 is a front view of the fuser device 37 as viewed from the upstream side of the sheet carrying direction (arrow A direction), FIG. 4 is a front view showing the fuser device 37 in which the external cover is removed, FIG. 5 is an external perspective view of the fuser device 37 in which the external cover is removed, FIG. 6 is a right side view showing the fuser device 37 in which the external cover is removed, FIG. 7 is a right side view of the fuser device in which a drive transmission system is further removed, and FIG. 8 is a view showing the A-A cross-section of FIG. 3 as viewed from the arrow direction. It should be noted that, in some following descriptions, the front and back, left and right, and up and down directions of the fuser device 37 may be specified as viewed from the arrow A direction when viewing the fuser device 37 shown in FIG. 2 from the front (plus end direction of X axis).

As shown in these figures, in the fuser device 37, a sheet loading part 101 in which the recording sheets 6 are loaded, a fuser roller drive input gear 201 provided in an upper stationary unit 200 (FIG. 9) to be described later and configured to receive an external rotation force for rotating the fuser roller 212 (FIG. 8) provided in the upper stationary unit 200, a cam drive input gear 401 provided in a base unit 400 (FIG. 9) to be described later and configured to receive a driving force from the outside to drive the cam mechanism provided in the base unit 400, and a handle 102, are arranged so as to be capable of being contacted externally.

When the fuser device 37 is mounted to a predetermined position inside the print part 3 as shown in FIG. 1, the fuser roller drive input gear 201 meshes with a connecting gear of an unillustrated fuser roller drive source provided inside the print part 3 and receives a driving force, and the cam drive input gear 401 meshes with an unillustrated connecting gear of a motor drive transmission system connected to a cam drive motor 611 (FIG. 26) to be described later and provided inside the print part 3.

Figure 9:
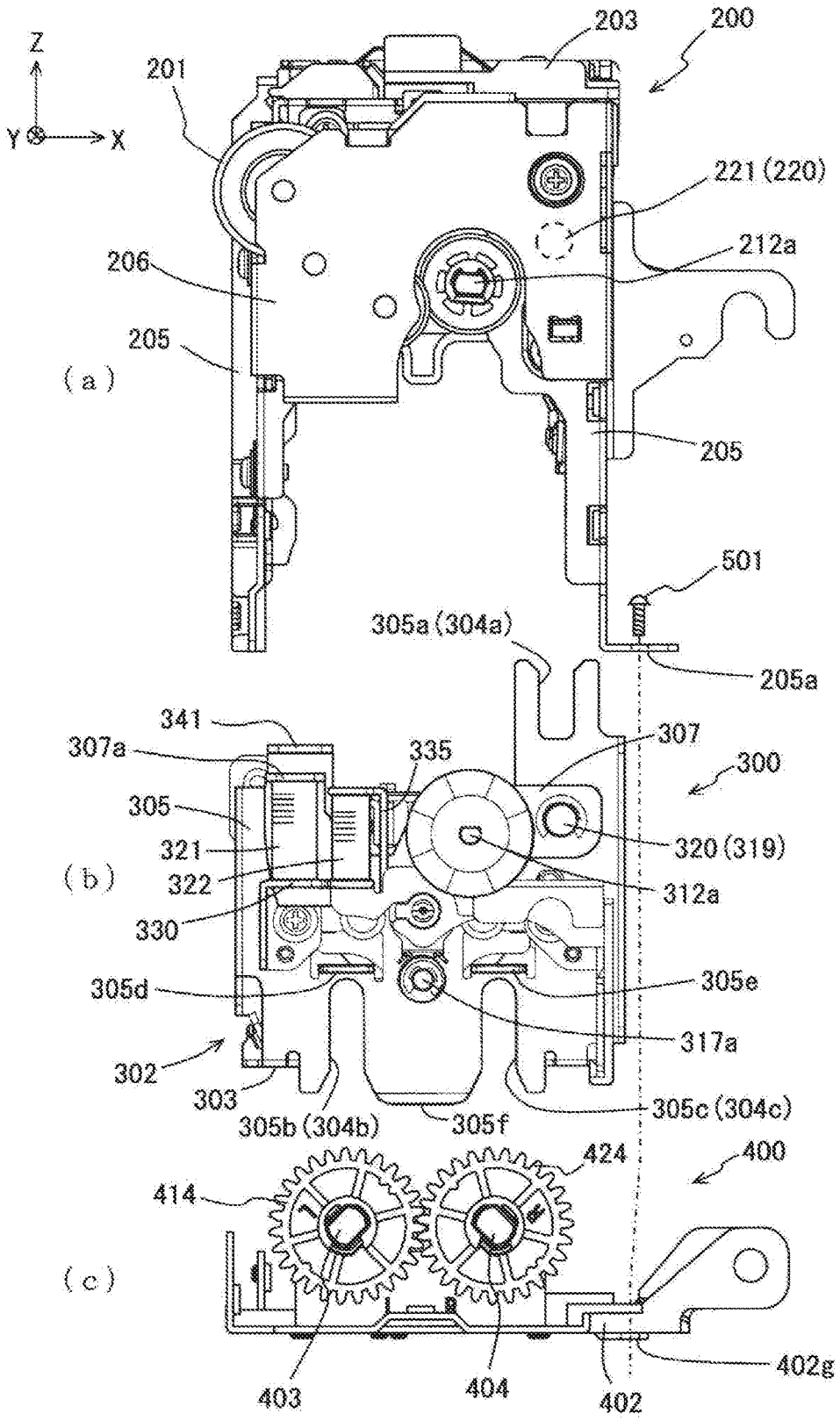
FIG. 9 is an exploded side view showing an upper stationary unit, a lower movable unit and a base unit constituting a fuser device in a state in which they are separated from each other, wherein (a) of FIG. 9 is a right side view of an upper stationary unit, (b) of FIG. 9 is a right side view of a lower movable unit, and (c) of FIG. 9 is a right side view of a base unit.
Figure 10:
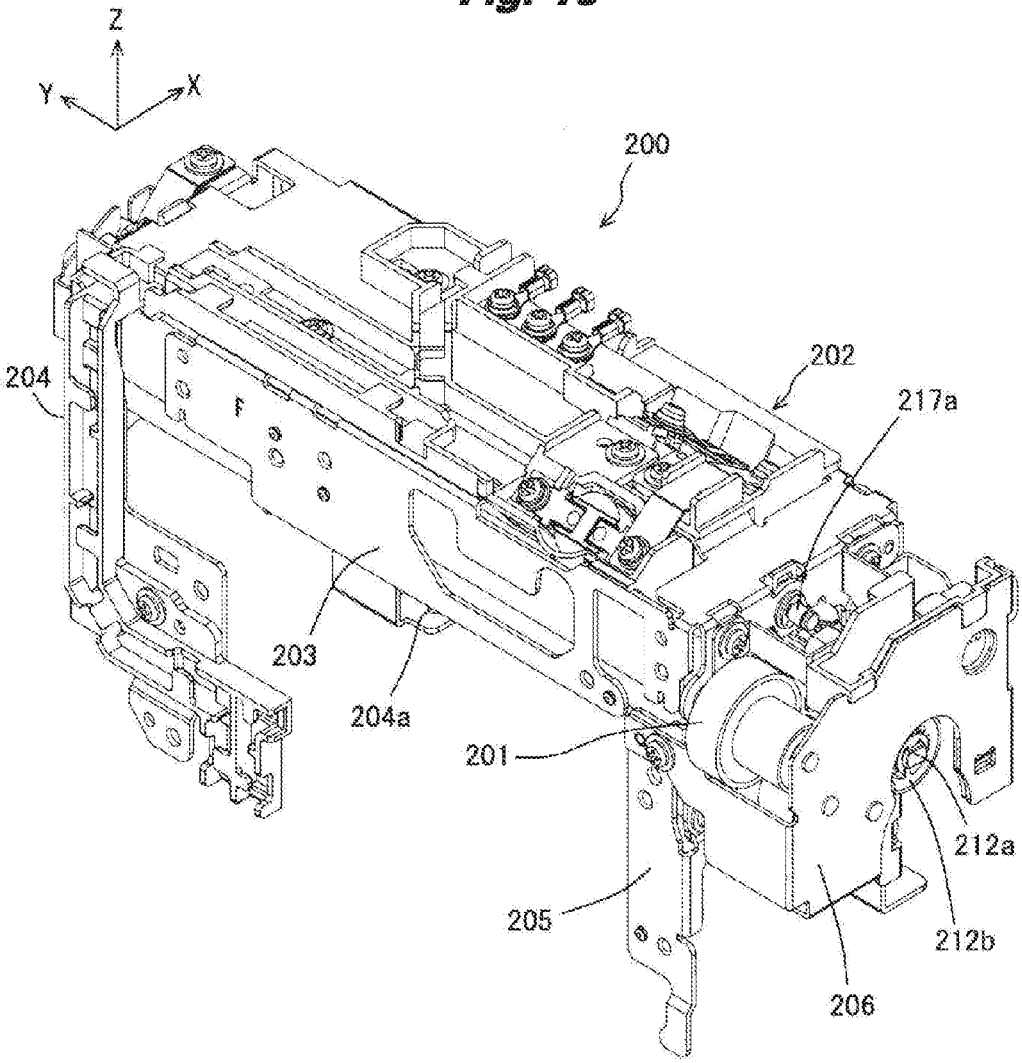
FIG. 10 is an external perspective view of an upper stationary unit.
Figure 11:
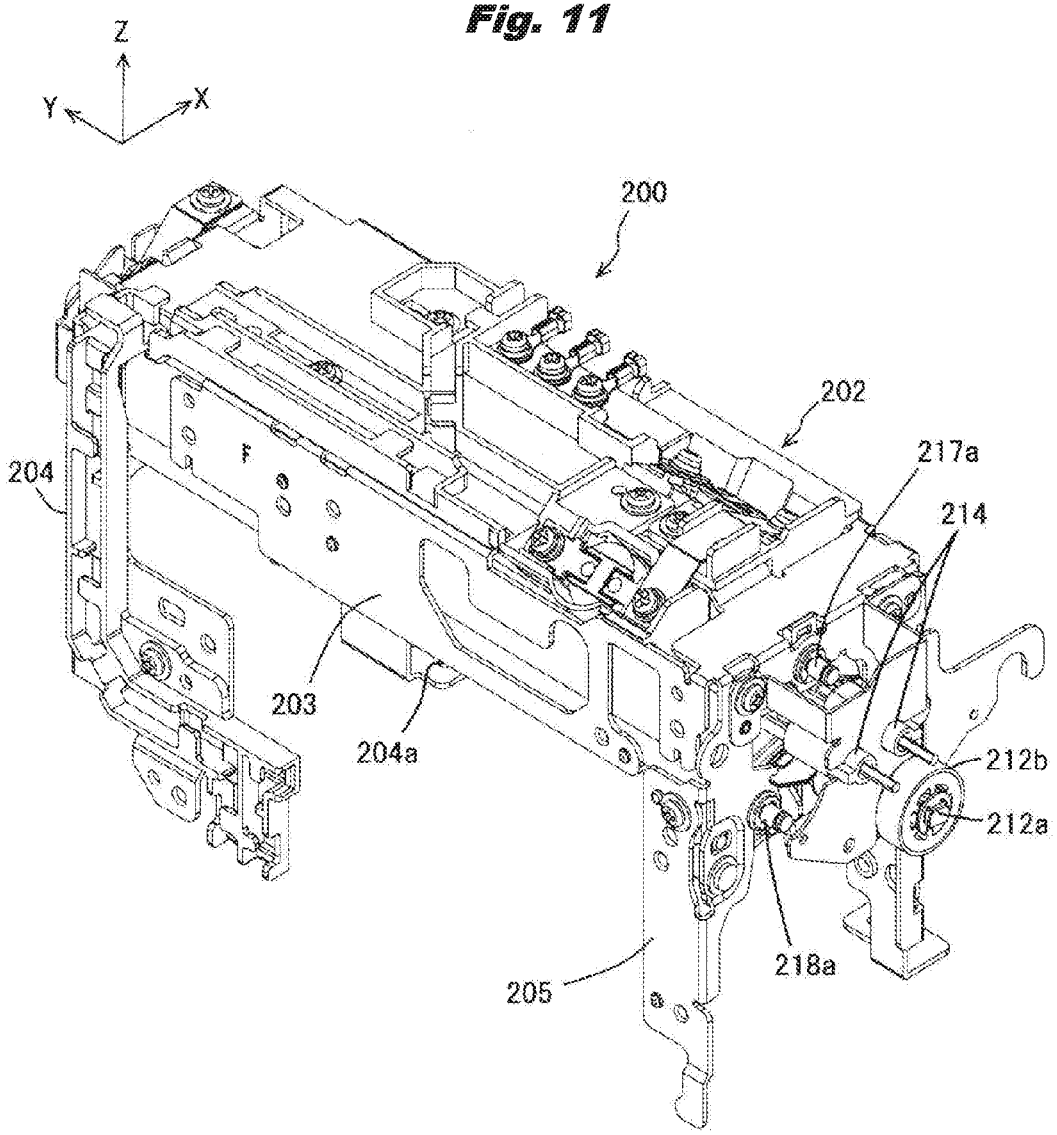
FIG. 11 is an external perspective view in which a drive transmission system including a fuser roller drive input gear is removed from the state shown in FIG. 10.
Figure 12:
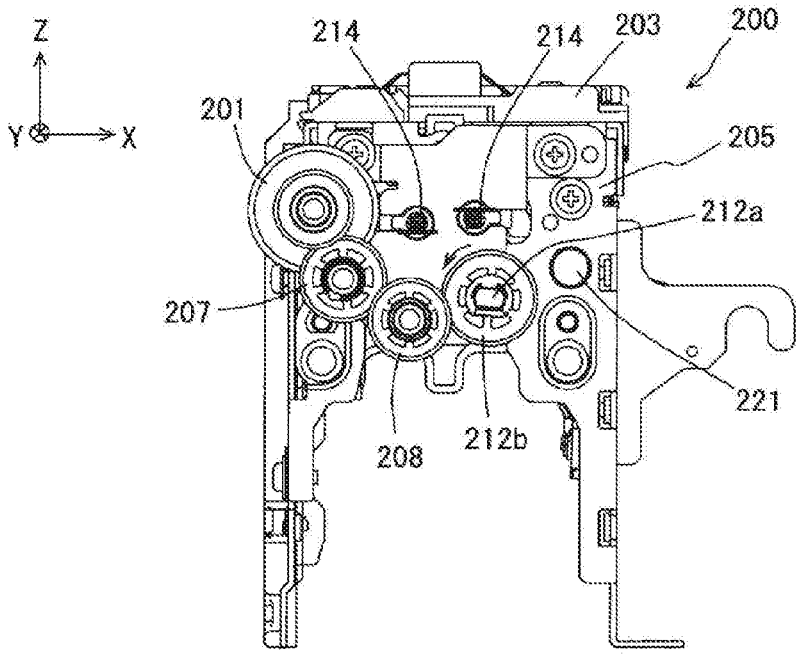
FIG. 12 is a right side view showing an upper stationary unit in which a sub-chassis of a drive transmission system is removed from the state shown in (a) of FIG. 9.
Figure 13:
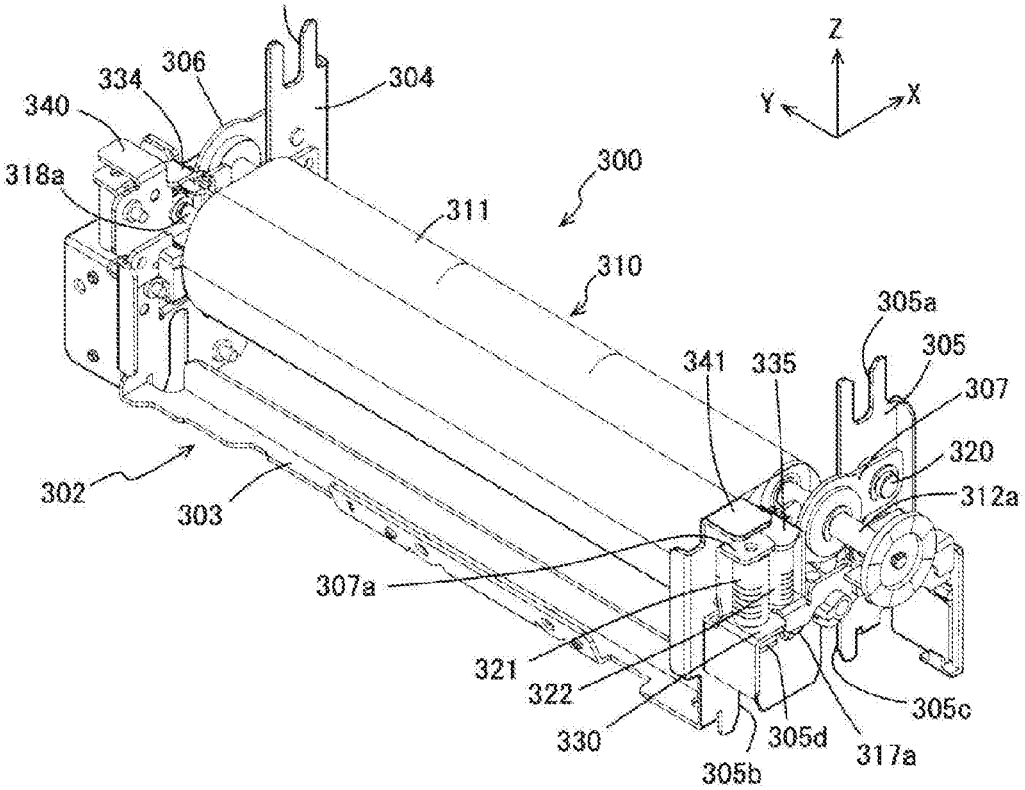
FIG. 13 is an external perspective view showing a lower movable unit.
Figure 14:
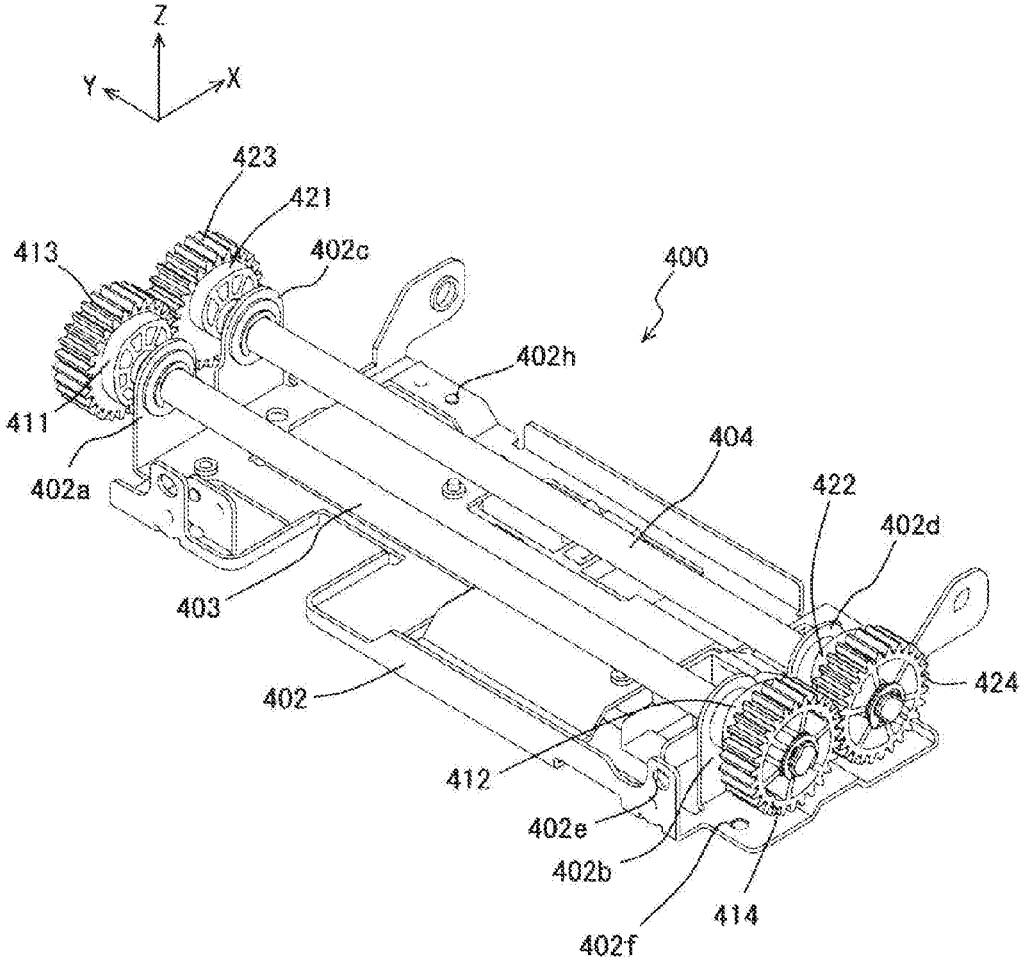
FIG. 14 is an external perspective view of a base unit.
Figure 15:
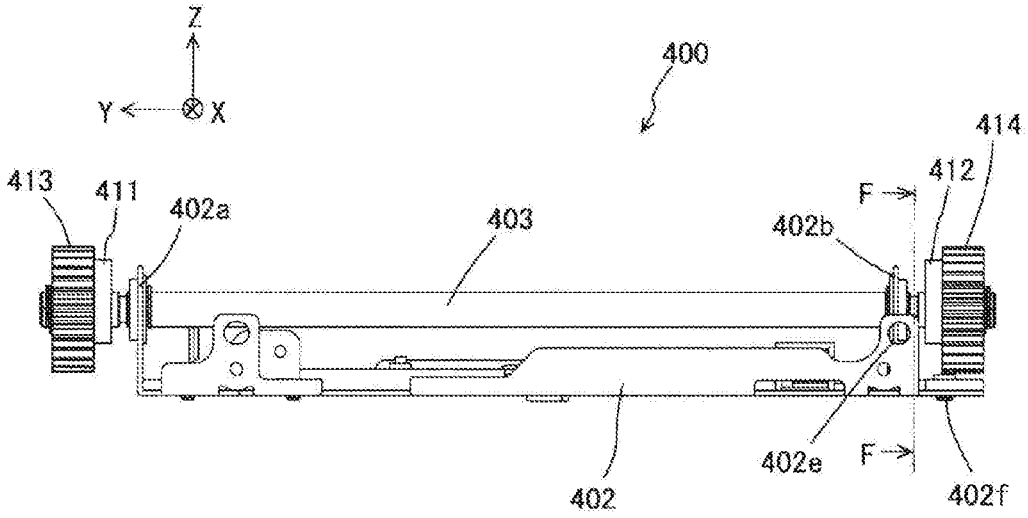
FIG. 15 is a front view of a base unit.
Figure 16:
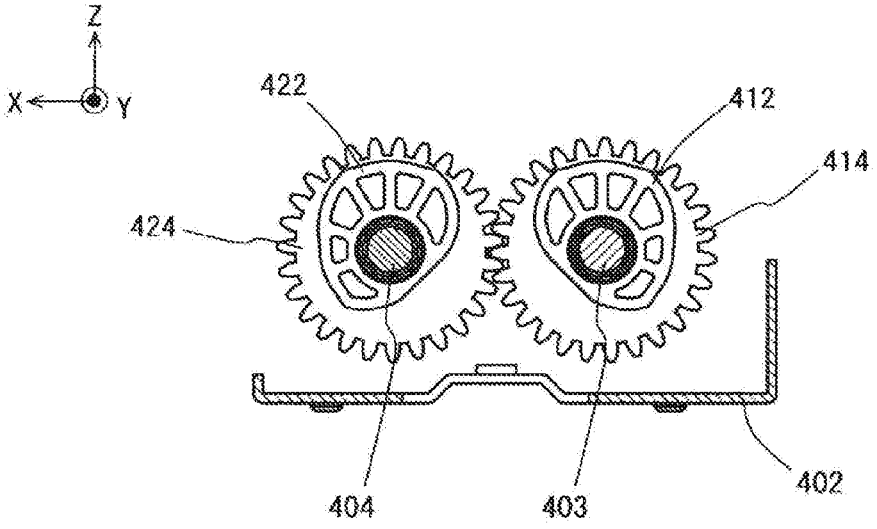
FIG. 16 is a view showing the F-F cross-section of FIG. 15 as viewed from the arrow direction.

FIG. 9 is an exploded side view showing the upper stationary unit 200, the lower movable unit 300, and the base unit 400 constituting the fuser device 37 in a state in which they are separated. (a) of FIG. 9 shows the right side view of the upper stationary unit 200, (b) of FIG. 9 shows the right side view of the lower movable unit 300, and (c) of FIG. 9 shows the right side view of the base unit 400. FIG. 10 is an external perspective view showing the upper stationary unit 200. FIG. 11 is an external perspective view in which a drive transmission system including a fuser roller drive input gear 201 is removed from the state shown in FIG. 10. FIG. 12 is a right side view showing the upper stationary unit 200 in which a sub-chassis 206 of a drive transmission system is removed from the state shown in (a) of FIG. 9. FIG. 13 is an external perspective view showing a lower movable unit 300. FIG. 14 is an external perspective view showing the base unit 400. FIG. 15 is a front view showing the base unit 400. FIG. 16 is a view showing the F-F cross-section of FIG. 15 as viewed from the arrow direction.

As shown in the A-A cross-sectional view of FIG. 8, inside the fuser device 37, a fuser unit 210 arranged in the upper stationary unit 200 and a pressure application unit 310 (see FIG. 13) arranged in the lower movable unit 300, extending in the left and right direction (hereinafter may be referred to as the longitudinal direction) are mounted.

The fuser unit 210, similarly to the pressure application unit 310 as shown in FIG. 13, includes: a fuser belt 211 as a first belt mainly formed in an endless shape and extending in the longitudinal direction in a region exceeding at least the width of the recording sheet 6 that passes through; a fuser roller 212 in contact with the inner circumferential surface of the fuser belt 211 and configured to movably drive the fuser belt 211; a roller guide member 213 consisting of two guide rollers 217 and 218 and a guide member, and configured to guide the inner circumferential surface of the fuser belt 211 by being in contact with the inner circumferential surface of the fuser belt 211, two heaters 214 arranged on the inside of the fuser belt 211 and configured to heat the fuser belt 211; a fuser pad 216 as a first pad; and a reflector 215 configured to reflect the heat from the heater 214 in a predetermined direction to the inner circumferential surface of the fuser belt 211.

The pressure application unit 310, as shown in FIG. 13, includes a pressure application belt 311 as a second belt mainly formed in an endless shape and extending in the longitudinal direction in a region exceeding at least the width of the recording sheet 6 that passes through, a pressure application roller 312 in contact with the inner circumferential surface of the pressure application belt 311 and configured to be driven by being contacted and pressed to the fuser roller 212 as described below to movably drive the pressure application belt 311, a roller guide member 313 consisting of two guide rollers 317 and 318 and a guide member and configured to guide the inner circumferential surface of the pressure application belt 311 by being in contact with the inner circumferential surface of the pressure application belt 311, a heater 314 arranged on the inside of the pressure application belt 311 and configured to heat the pressure application belt 311, a pressure application pad 316 as a second pad, and a reflector 315 configured to reflect the heat from the heater 314 in a predetermined direction of the inner circumferential surface of the pressure application belt 311.

The pressure application unit 310, as described later, moves in the up and down direction so as to come in and out of contact with the fuser unit 210, but as shown in FIG. 8, when the fuser roller 212 and the pressure application roller 312 are at a nip position forming a nip part, the pressure application pad 316 also comes into contact with the fuser pad 216, and the fuser belt 211 and the pressure application belt 311, and the fuser belt and the pressure application belt 311 each sandwiched between the fuser pad 216 and the pressure application pad 316, respectively, form a linear carrying path.

In this state, when the fuser roller 212 obtains an external driving force and rotates in the arrow direction as described later, along with the pressure application roller 312 that is driven accordingly, the fuser roller 212 rotatably moves the fuser belt 211 and the pressure application belt 311 in the arrow direction. In this state, when the recording sheet 6 in which toner images were transferred is carried to the joining part of the fuser belt 211 and the pressure application belt 311 via the sheet loading part 101, it is further sandwiched between the fuser belt 211 heated by the heater 214 and the pressure application belt 311 heated by the heater 314 and carried along a linear carrying path, and the toner images are fused to the recording sheet 6 due to the heat application and the pressure application received during that time, and the recording sheet 6 is ejected to a latter ejection roller pair 38 (FIG. 1).

(Upper Fixed Unit 200)

The upper stationary unit 200 provided with the fuser unit 210 (FIG. 8), as shown in (a) of FIG. 9 and FIGS. 10 to 12, includes a main chassis 202 including a left side chassis 204 joined to an upper chassis 203 and an upper chassis 203, and a right side chassis 205 joined to the upper chassis 203, and the left and right side chassis 204 and 205 rotatably hold the rotation shaft 212*a* of the fuser roller 212 of the fuser unit 210 and each of the rotation shafts 217*a* and 218*a* of the guide rollers 217 and 218 at both end portions. Further, at a position of the left and right side chassis 204 and 205 facing the rear upper part of the fuser roller 212, a left engagement post 220 (not illustrated) and a right engagement post 221 (FIG. 12) protruding to the left and right, respectively, are provided.

The right side chassis 205 fixedly holds the sub-chassis 206, and between it and the sub-chassis 206, rotatbly holds a fuser roller drive input gear 201, and as shown in FIG. 12, a first intermediate gear 207 which meshes to the fuser roller drive input gear 201, and a second intermediate gear 208 which meshes with a fuser roller gear 212*b* fixedly arranged on a rotation shaft 212*a* of the first intermediate gear 207 and the fuser roller 212.

From the aforementioned configuration, when the fuser roller drive input gear 201 meshes with a connecting gear of an unillustrated fuser roller drive source provided inside the print part 3 (FIG. 1) and receives a rotation force in a predetermined direction, the rotation force is transmitted to the rotation shaft 212*a* of the fuser roller 212 via the first and second intermediate gears 207 and 208, so that the fuser roller drive input gear 201 rotates the fuser roller 212 counterclockwise in the arrow direction (FIG. 8).

(Lower Movable Unit 300)

The lower movable unit 300 provided with the pressure application unit 310 (FIG. 8), as shown in (b) of FIG. 9 and FIG. 13, includes a main chassis 302 including a left side chassis 304 joined to a lower chassis 303 and a lower chassis 303, and a right side chassis 305 joined to the lower chassis 303, and the left and right side chassis 304 and 305 rotatably hold each of the rotation shafts 317*a* and 318*b* of the guide rollers 317 and 318 of the pressure application unit 310 (FIG. 13) and further, as described later, hold both end parts of the rotation shaft 312*a* of the pressure application roller 312 via the left and right arms 306 and 307, which serve as supporting members.

Figure 23:
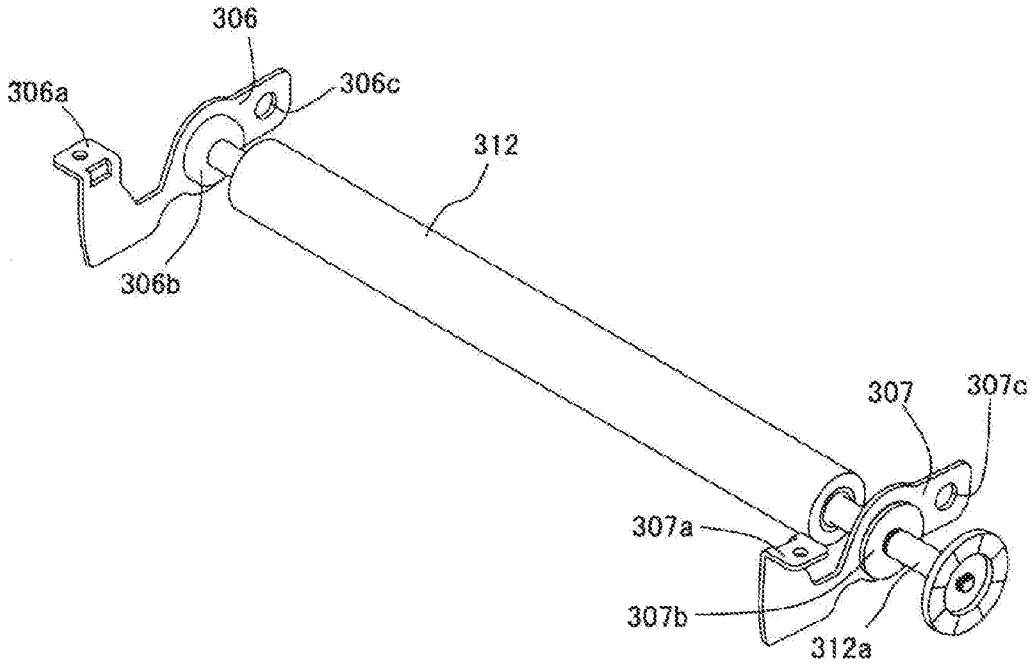
FIG. 23 is an external perspective view showing a pressure application roller and left and right arm portions holding the pressure application roller as viewed diagonally from above.

FIG. 23 is an external perspective view showing a pressure application roller 312 and left and right arms 306 and 307 holding the pressure application roller 312 as viewed from diagonally above.

Here, the configuration in which the left and right side chassis 304 and 305 hold both end parts of the rotation shaft 312*a* of the pressure application roller 312 via the left arm 306 and the right arm 307 is configured to be a plane symmetry to the virtual central plane (vertical to the rotation shaft 312*a*) in middle of the left and right side chassis 304 and 305, so here, only the configuration of the right side is illustrated, and it will be described with references to (b) of FIG. 9, FIG. 13, as well as FIGS. 17 to 20.

Figure 17:
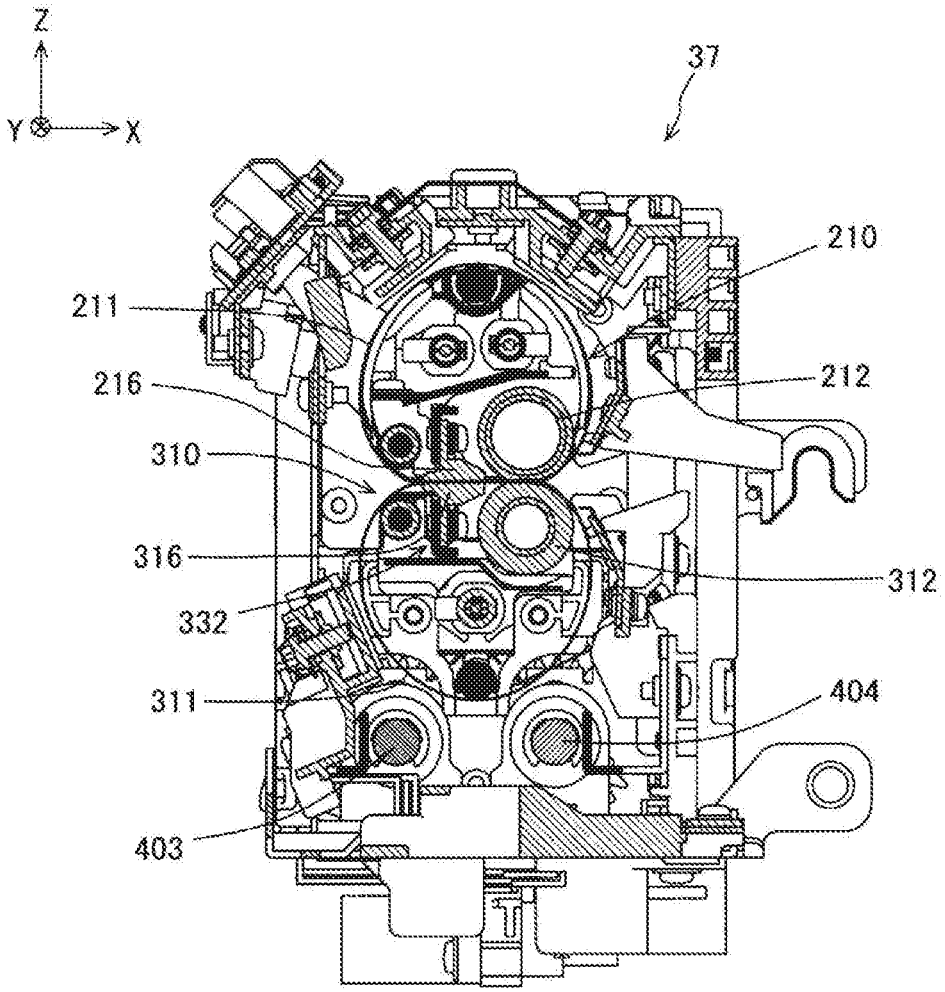
FIG. 17 is a view showing the B-B cross-section in FIG. 4, which is a front view of a fuser device with the external cover removed as viewed from the arrow direction.
Figure 18:
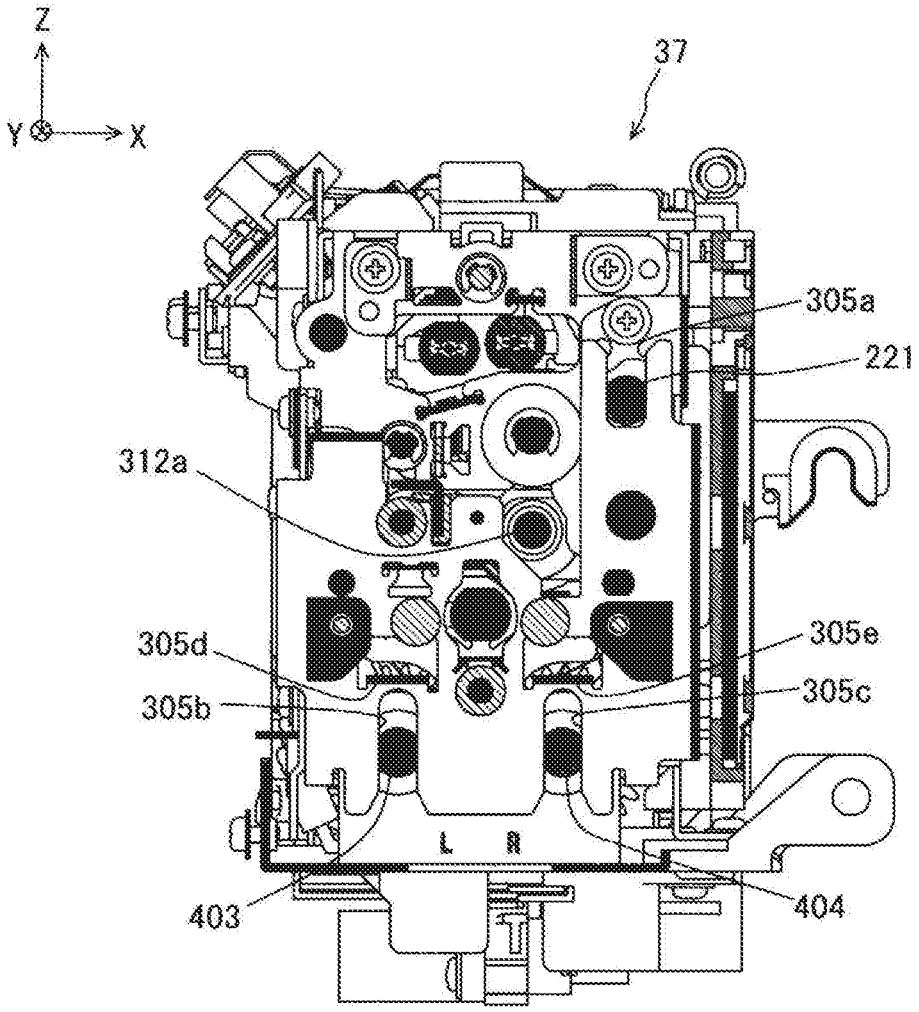
FIG. 18 is a view showing the C-C cross-section of FIG. 4, which is a front view of a fuser device with the external cover removed as viewed from the arrow direction.
Figure 19:
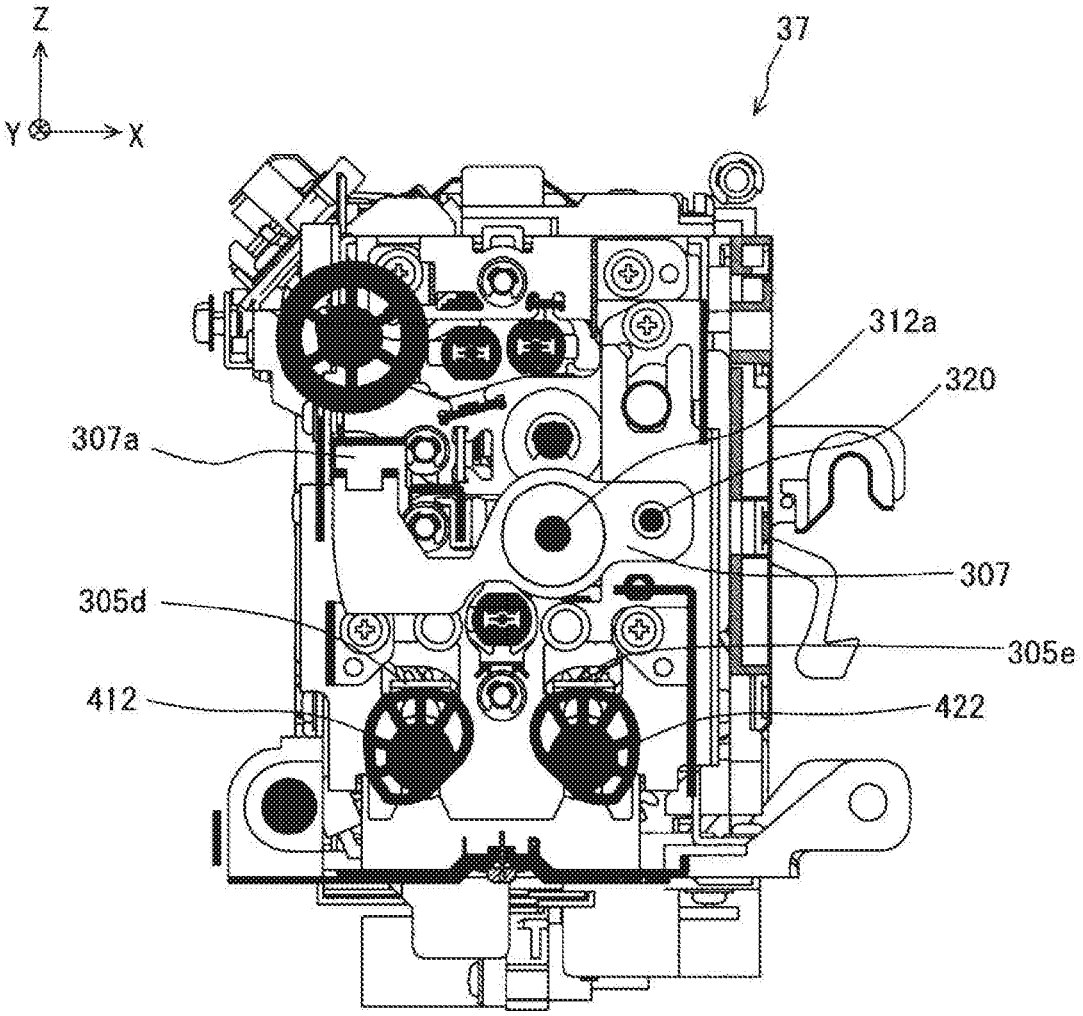
FIG. 19 is a view showing the D-D cross-section of FIG. 4, which is a front view of a fuser device with the external cover removed as viewed from the arrow direction.
Figure 20:
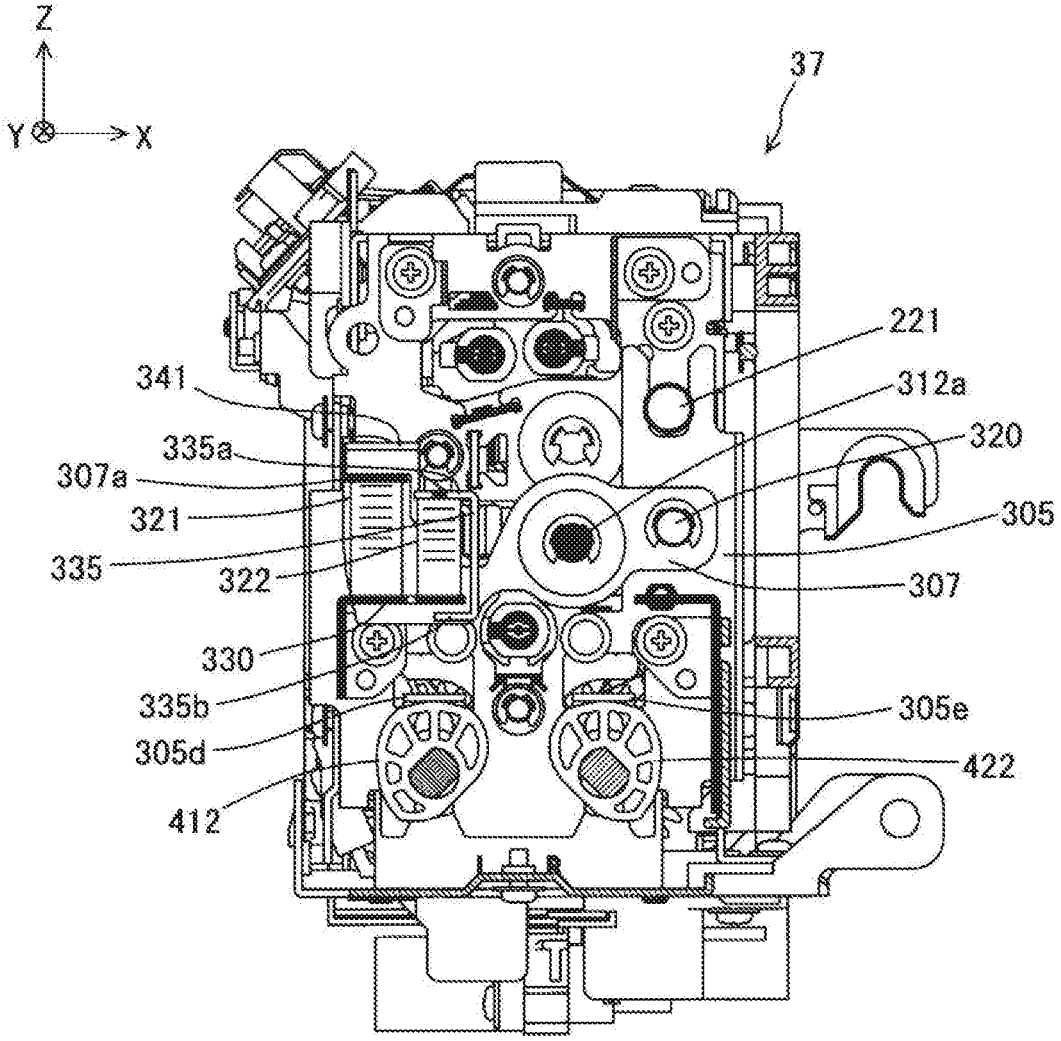
FIG. 20 is a view showing the E-E cross-section of FIG. 4, which is a front view of a fuser device with the external cover removed as viewed from the arrow direction.

FIG. 17 is a view showing the B-B cross-section in FIG. 4, which is a front view of a fuser device 37 with the external cover removed and viewed from the arrow direction. FIG. 18 is a view showing the C-C cross-section of FIG. 4 viewed from the arrow direction. FIG. 19 is a view showing the D-D cross-section of FIG. 4 viewed from the arrow direction. FIG. 20 is a view showing the E-E cross-section of FIG. 4 viewed from the arrow direction.

The right side chassis 305 is equipped with a rotation shaft 320 mounted slightly to the right direction from the upper part of the rear part, and the rotation shaft 320 is inserted into the shaft hole 307*c* of the right arm as an arm (FIG. 23) to rotatably hold the right arm 307. Similarly, the rotation shaft 319 of the left side chassis 304 is also inserted into the shaft hole 306*c* of the left arm 306 (FIG. 23) to rotatably hold the left arm 306. With this, the arms 306 and 307 can be pivoted about the rotation shafts 319 and 320.

The right arm 307 is arranged so as to extend in the front and back direction (X-axis direction) as shown in FIG. 19, etc., and engaged with the upper end side of the first spring 321 as a first bias member arranged in the up and down direction by an engaging part 307*a* formed by bending in a right direction at the front end side upper part. In the first spring 321, the lower end side is engaged with a spring engaging member 330 arranged in the right side chassis 305 and maintains the compressed state.

The right arm 307, as shown in FIG. 13 and FIG. 20, for example, forms a bearing 307*b* (FIG. 23) at a position close to the rotation shaft 320 between the engaging part 307*a* and the rotation shaft 320 at the front edge, and rotatably holds one end side of the rotation shaft 312*a* of the pressure application roller 312 with the bearing 307*b*, and the left arm 306 similarly rotatably holds the other end side of the rotation shaft 312*a* of the pressure application roller 312 with a bearing 306*a* (FIG. 23). Therefore, the pressure application roller 312 is configured to be displaceable (slidable) to the main chassis 302 due to the revolution of the left and right arms 306 and 307. As described later, the engaging part 307*a* of the right arm 307 biased by the first spring 321 is in contact with a regulation plate 341 (or regulation member) and the regulation plate 341 regulates the rotation of the right arm 307.

Figure 24:
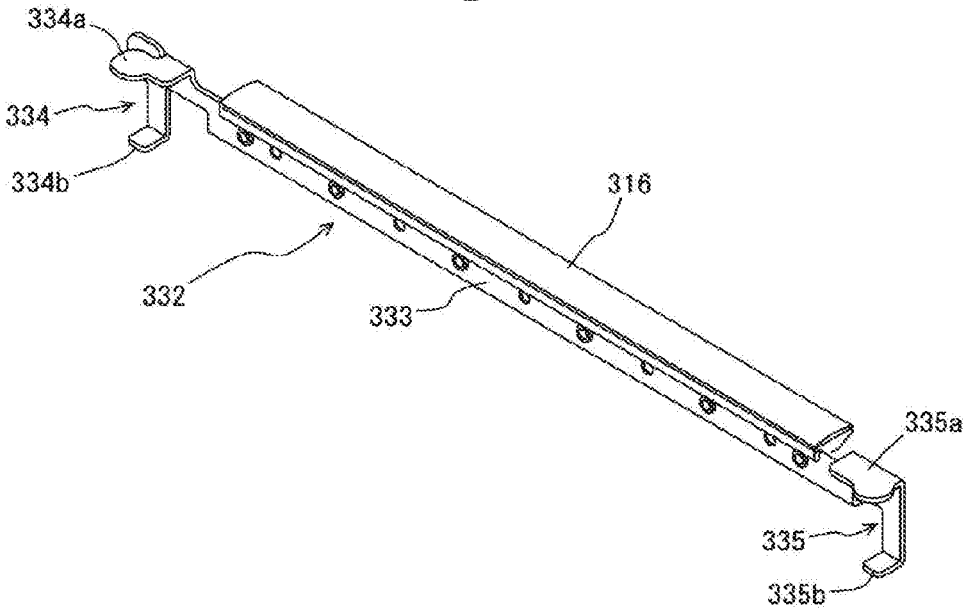
FIG. 24 is an external perspective view showing a pressure application pad and a pressure application pad holder holding the pressure application pad.

The pressure application pad 316 (FIG. 8) is arranged so as to extend in the longitudinal direction of the pressure application unit 310 in an approximately same region as the pressure application belt 311. FIG. 24 is an external perspective view showing a pressure application pad 316 and a pressure application pad holder 332 holding the pressure application pad. As shown in the figure, in the pressure application pad holder 332, a pad fixture part 333 in which the pressure application pad 316 is fixed, a left end part 334 formed at both end parts of the pad fixture part 333 (FIG. 13), and a right end part 335 are integrally formed. The pressure application pad holder 332 is slidably held by the main chassis 302 in the up and down direction, and its left and right end parts 334 and 335 are formed in a U-shape, respectively (see FIG. 20).

The upper face portion 335*a* of the right end part 335 is adjacent to the first spring 321 and arranged in the up and down direction and engaged with the upper end side of the second spring, and the lower end side of the second spring 322 is engaged with the spring engaging member 330 arranged in the right side chassis 305 and is maintained in the compressed state.

In the left and right side chassis 304 and 305, a left upper part slit 304*a* and a right upper part slit 305*a*, in which the upper portions are open, are formed at opposing positions at the rear upper parts, and at the opposing position at the lower part, a left lower front part slit 304*b* and a right lower front part slit 305*b* as the first guide grooves in which the lower portions are open, and a left lower rear part slit 304*c* and a right lower rear part slit 305*c* as second guide grooves are formed.

(Base Unit 400)

The base unit 400 provided with a cam mechanism is equipped with a base chassis 402 extending in the left and right direction (longitudinal direction) as shown in (c) of FIG. 9 and FIGS. 14 to 17. In the base chassis 402, at both end parts in the longitudinal direction, a pair of supporting plates 402*a* and 402*b* rotatably holding the first cam shaft 403, and a pair of supporting plates 402*c* and 402*d* rotatably holding the second cam shaft 404 arranged so as to be parallel and adjacent to the first cam shaft 403 are formed.

In the first cam shaft 403, a cam 411 as a first cam and a cam gear 413 are fixedly arranged on the left side end part in a coaxial manner, and a cam 412 as a first cam and a cam gear 414 are fixedly arranged on the right side end part in a coaxial manner. In the second cam shaft 404, a cam 421 as a second cam and a cam gear 423 are fixedly arranged on the left side end part in a coaxial manner, a cam 422 and a cam gear 424 are fixedly arranged on the right side end part in a coaxial manner, and the cam gear 413 and the cam gear 423, and the cam gear 414 and the gear 424 are arranged so as to mesh with each other respectively at both end parts.

In the base chassis 402, as shown in FIG. 5, screw holes 402*e* and 402*f* for screwing the holding plate 430 configured to rotatably hold the cam drive input gear 401 are formed, and as shown in FIG. 5, the holding plate 430 is arranged so as to be fixed by screwing so that the cam drive input gear 401 meshes with the cam gear 414.

As shown in FIG. 16, the cams 412 and 422 are arranged so as to have plane symmetry shapes with respect to the virtual central plane between the first cam shaft 403 and the second cam shaft 404. Further, the cam 411 is arranged on the first cam shaft 403 in the same shape and with the same angle as the cam 412, and the cam 421 is arranged on the second cam shaft 404 in the same shape and with the same angle as the cam 422.

Next, the attachment relationships of the upper stationary unit 200, the lower movable unit 300, and the base unit 400 will be described.

When the lower movable unit 300 is installed on the base unit 400, as shown in FIG. 9, the right side of the fuser device 37 is arranged so that the first cam shaft 403 of the base unit 400 is slidably inserted into the right lower front part slit 305*b* formed on the right side chassis 305, and similarly, the second cam shaft 404 of the base unit 400 is slidably inserted into the right lower rear part slit 305*c* (see FIG. 18). Furthermore, the lower movable unit is installed so that the cam 412 of the first cam shaft 403 is in contact with the abutment projection plate 305*d* formed on the top part of the right lower front part slit 305*b* as a first engagement part, and the cam 422 of the second cam shaft 404 is in contact with the abutment projection plate 305*e* formed on the top part of the right lower rear part slit 305*c* as a second engagement part (see FIG. 19).

At this time, the left side of the fuser device 37 is also arranged so that the first cam shaft 403 of the base unit 400 is slidably inserted into the left lower front part slit 304*b* formed in the left side chassis 304 (FIG. 13), and similarly, the second cam shaft 404 of the base unit 400 is slidably inserted into the left lower rear part slit 304*c*, and furthermore, the cam 411 of the first cam shaft 403 is in contact with the abutment projection plate 304*d* (not illustrated) formed on the top part of the left lower front part slit 304*b*, and the cam 421 of the second cam shaft 404 is in contact with the abutment projection plate 304*e* (not illustrated) formed on the top part of the left lower rear part slit 304*c* (see FIG. 19).

Next, the upper stationary unit 200 is fixed to the base unit 400, but at this time, on the right side of the fuser device 37, the right engagement post 221 arranged on the right side chassis 205 of the upper stationary unit 200 (see FIG. 12) is arranged so as to be inserted into the upper right part slit 305*a* formed on the lower movable unit 300, and similarly, on the left side of the fuser device 37, the left engagement post 220 arranged on the left side chassis 204 of the upper stationary unit 200 is arranged so as to be inserted in the left upper part slit 304*a* formed on the lower movable unit (see FIG. 13).

Further, as shown in FIG. 9, the attachment hole 205*a* formed at the lower part of the right side chassis 205 and the screw groove 402*g* formed in the base chassis 402 of the base unit 400 so as to face the attachment hole 205*a* are joined by a set screw 501 to fix the upper stationary unit 200 to the base unit 400. Further, the fixture of the upper stationary unit 200 by the set screw 501 may be performed at other positions, such as a plurality of positions, for example, between an attachment hole 204*a* formed at a lower part of the left side chassis 204 (FIG. 10) and a screw groove 402*h* formed in the base chassis 402 (FIG. 14) as needed.

With the aforementioned configuration, the lower movable unit 300, on the right side of the fuser device 37, as shown in FIG. 18, is guided by the first cam shaft 403 and the second cam shaft 404 of the base unit 400 and the right engagement post 221 of the upper stationary unit 200, and on the left side of the fuser device 37, similarly, it is guided by the first cam shaft 403 and the second cam shaft 404 of the base unit 400 and the left engagement post 220 of the upper stationary unit 200 (not illustrated). Also, the lower movable unit 300 is held so as to be movable in the up and down direction, and furthermore, it moves in the up and down direction according to the rotation of the four cams 411, 412, 421 and 422 on the left and right.

Here, the base chassis 402 and the first and second cam shafts 403 and 404 of the base unit 400, and the upper stationary unit 200 fixed to the base chassis 402 correspond to a first unit; the lower movable unit 300 movably held by the first unit corresponds to a second unit; the cams 411, 412, 421, and 422, the first and second cam shafts 403 and 404, the cam gears 413, 414, 423, and 424, the cam drive input gear 401, and the holding plate 430 correspond to a movement mechanism; and among them, the cam gears 413, 414, 423, and 424, the cam drive input gear 401, and the holding plate 430 correspond to the drive transmission system. When the unit 200 and the unit 300 are attached, the position is defined as a first position of the invention where a fusing operation is performed. When the unit 200 and the unit 300 are not attached, the position is defined as a second of the invention where a fusing operation is not performed.

Further, the cam mechanism arranged on the left and right of the fuser device 37 and configured to move the lower movable unit 300 up and down is configured to be in plane symmetry with respect to the virtual central plane between the left and right side chassis 304 and 305 (vertical with respect to the cam shafts 403 and 404) with the exception of the holding plate 430 for rotatably holding the cam drive input gear 401, and since the operations are the same, hereinafter, the operations will be described only for the mechanism on the right side.

(Explanation of Operations)

The first cam shaft 403 and the second cam shaft 404, when the cam drive input gear 401 meshes with an unillustrated connecting gear of the motor drive transmission system connected to a cam drive motor 611 (FIG. 26) to be described later and provided inside the print part 3 (FIG. 1) and receives a rotation force in a predetermined direction, the rotation force is transmitted to the first cam shaft 403 and the second cam shaft 404 via the cam gears 414 and 424, and for example, rotates the cam 412 and the cam 422 as shown in FIG. 16 in the opposite directions at the same speed.

FIG. 17 and FIG. 20 show states in which the lower movable unit 300 (see FIG. 9) is slid to the lowermost position by the cam mechanism, and at this time as shown in FIG. 17, the pressure application roller 312 presses the fuser roller 212 and forms the nip part. At this time, the engaging part 307*a* and the regulation plate 341 are detached, and since the bottom end face 335*b* and the spring engaging member 330 are detached, the bias force of the first spring 321 can be applied to the nip part and the bias force of the second spring 322 can be applied to the pressure application pad 316.

Figure 21:
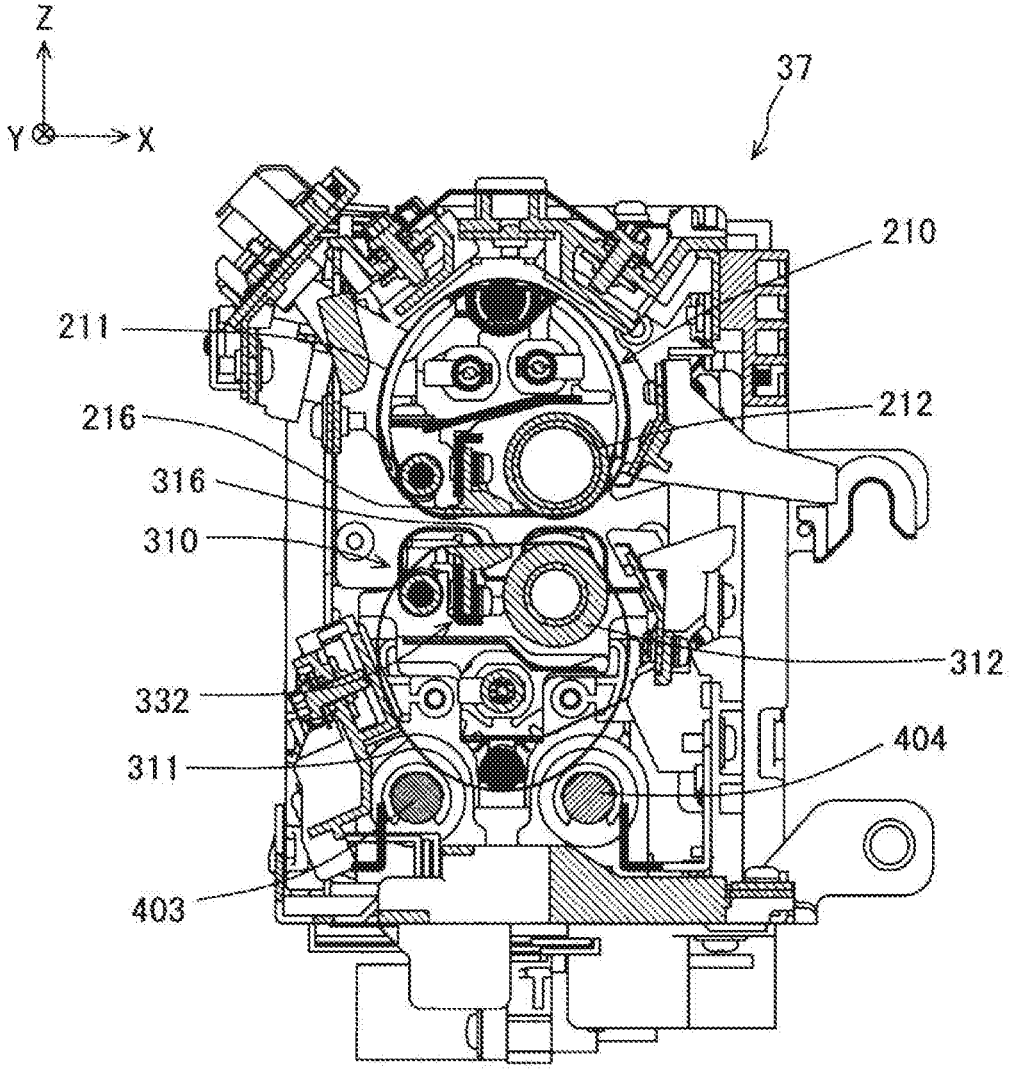
FIG. 21 is a view showing the B-B cross-section of FIG. 4 as viewed from the arrow direction in a state in which a lower movable unit is slid to the lowermost position by a cam mechanism.
Figure 22:
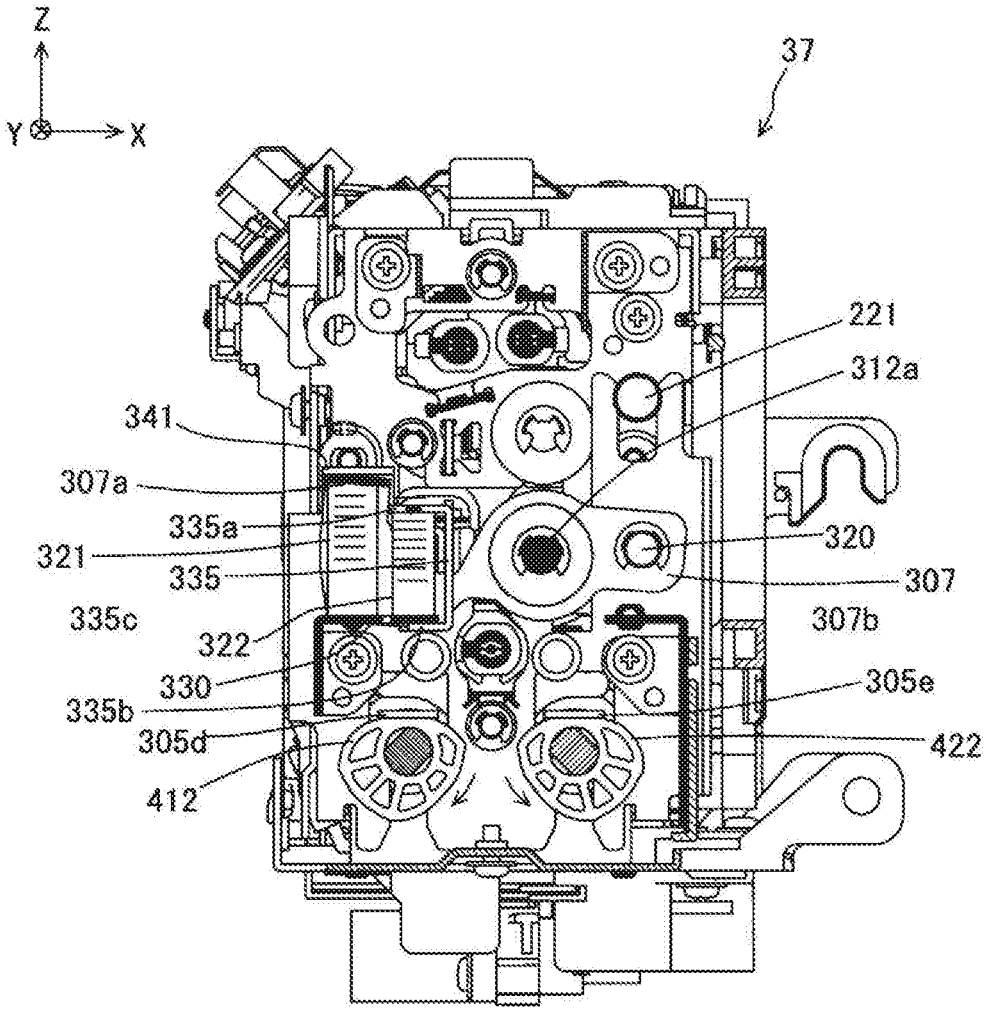
FIG. 22 is a view showing the E-E cross-section of FIG. 4 as viewed from the arrow direction in a state in which a lower movable unit is slid to the lowermost position by a cam mechanism.

On the other hand, FIG. 21 is a view showing the B-B cross-section in FIG. 4, which is a front view of a fuser device 37 in which the external cover is removed as viewed from the arrow direction, showing a state in which the lower movable unit 300 (see FIG. 9) is slid to the lowermost position by the cam mechanism. Similarly, FIG. 22 is a view showing the E-E cross-section in FIG. 4 as viewed from the arrow direction, showing a state in which the lower movable unit 300 (see FIG. 9) is slid to the lowermost position by the cam mechanism. At this time, as shown in FIG. 21, the pressure application unit 310 is in a state in which it is detached from the fuser unit 210.

Hereinafter, the operations of each part when the lower movable unit 300 slides between the uppermost position and the lowermost position will be described. Further, all of the figures other than FIG. 21 and FIG. 22 show states in which the lower movable unit 300 is positioned at the uppermost position as a convenience.

For example, in FIG. 19, the abutment projection plates 305*d* and 305*e* of the lower movable unit 300 are maintained in a state in which they are in contact with the circumferential surfaces of the cams 412 and 422 at all times due to the self-weight of the lower movable unit 300. Therefore, when the cams 412 and 422 are at a rotation position as shown in FIG. 22, in which the contact position is at the lowermost position, the lower movable unit 300 is at the lowermost position. Hereinafter, the lowermost position of the lower movable unit 300 may be referred to as a detached position.

At this time, the right arm 307 is biased in the clockwise direction by the first spring 321 (FIG. 22), but the rotation in that direction is regulated in a state in which the engaging part 307*a* of the front edge is contacted and pressed against the regulation plate 341. The rotation position of the right arm 307 at this time may be hereinafter referred to as an initial rotation position.

On the other hand, in the right end part 335 of the pressure application pad holder 332 (FIG. 8), the upper face portion 335*a* is biased upwards by the second spring 322, but the bottom face portion 335*b* is in contact with the bottom face of the spring engaging member 330 to regulate the movement in the direction. The movement position of the pressure application pad holder 332 at this time may be hereinafter referred to as an initial movement position.

FIG. 21 is a view showing the B-B cross-section of FIG. 4 as viewed from the arrow direction when the lower movable unit 300 is at the detached position. As shown in the figure, the pressure application unit 310 arranged in the lower movable unit 300 is in a state in which it is detached from the fuser unit 210 arranged in the upper stationary unit 200 (see FIG. 9). At this time, the uppermost portion of the pressure application roller 312 rotatably held by the right arm 307 in an initial rotation position and the uppermost portion of the pressure application pad 316 held by the pressure application pad holder 332 at the initial moving position are set to be approximately the same height and support the pressure application belt 311.

When the lower movable unit 300 rotatably drives the cam drive input gear 401 in, for example, the arrow C direction (FIG. 5) from the state shown in FIG. 21 and FIG. 22 in which it is at a detached position, the cams 412 and 422 rotate in different arrow directions (FIG. 22) at the same speed and gradually push the abutment projection plates 305*d* and 305*e*, that is, the lower movable unit 300, upwards. Accordingly, for example, the pressure application unit 310 as shown in FIG. 21 moves upwards and eventually presses the fuser unit 210 arranged in the upper stationary unit 200. That is, the pressure application roller 312 and the pressure application pad 316 of the pressure application unit 310 each come in contact with the fuser roller 212 and the fuser pad 216 via the pressure application belt 311 and the fuser belt 211.

When the lower movable unit 300 is further pushed up by the rotation of the cam 412 and the cam 422, the pressure application roller 312 contacts and is pressed against the fuser roller 212 and the pressure application pad 316 contacts and is pressed against the fuser pad 216, respectively, but both stop the upward movement. Accordingly, for example, the right arm 307 shown in FIG. 20 and its engaging part 307*a*, and the pressure application pad holder 332 (FIG. 17) and its right end part 335 stop at the position as shown in the figure, but the main body of the lower movable unit 300 is further lifted.

With this, the right end part 335 of the pressure application pad holder 332 moves downward from the initial movement position relative to the right side chassis 305 and the bottom face portion 335*b* comes into a state in which it is detached from the bottom face of the spring engaging member 330; the right arm 307 rotates counterclockwise from the initial rotation position relative to the right side chassis 305 and its engaging part 307*a* comes into a state in which it is detached from the regulation plate 341; and the lower movable unit 300 eventually reaches the uppermost position as shown in FIG. 20 and stops the upward movement. Hereinafter, the uppermost position of the lower movable unit 300 may be referred to as a nip position.

Therefore, when the lower movable unit 300 is at the nip position as shown in FIG. 17 and FIG. 20, the pressure application roller 312 is further compressed and biased by the first spring 321 with an increased bias force, and presses the fuser roller 212 via the pressure application belt 311 and the fuser belt 211 to form a desired nip part. Further, the pressure application pad 316 is further compressed and biased by the second spring 322 with an increased bias force and presses the pressure application belt 311 and the fuser belt 211 against the fuser pad 216 with a predetermined pressure.

As described above, when the lower movable unit 300 is at the nip position, the pressure application roller 312 and the pressure application pad 316 are biased independently by separate springs, so the appropriate bias force can be applied separately to each of them, thereby contributing to the stability of the fusing process.

When the lower movable unit 300 further rotatably drives the cam drive input gear 401 in, for example, the arrow C direction (FIG. 5) from the state in which it is at the nip position, the cams 412 and 422 rotate in different arrow directions (FIG. 22) at the same speed and gradually push the abutment projection plates 305*d* and 305*e* in contact, that is, the lower movable unit 300, downwards.

With this, the right end part 335 of the pressure application pad holder 332 moves upwards toward the initial movement position relative to the right side chassis 305 and the bottom face portion 335*b* comes into a state in which it is in contact with the bottom face of the spring engaging member 330, and the right arm 307 rotates counterclockwise toward the initial rotation position relative to the right side chassis 305 and its engaging part 307*a* comes into a state in which it is in contact with the regulation plate 341.

During this time, the nip part formed between the pressure application roller 312 and the fuser roller 212 is cancelled and the pressure by the pressure application pad 316 to the fuser pad 216 from the pressure application belt 311 and the fuser belt 211 is cancelled.

Hereinafter, the lower movable unit 300 integrally moves downwards and eventually reaches the lowermost position (detached position) as shown in FIG. 21 and FIG. 22 and stops the downward movement.

Further, here, in a direction parallel to the plane including the first cam shaft 403 and the second cam shaft 404 and orthogonal to these cam shafts (X-axis direction), the rotation shaft 312*a* of the pressure application roller 312 at the nip position is positioned between the first cam shaft 403 and the second cam shaft 404. With this, the biasing by the pressure application roller 312 to the fuser roller 212 can be performed stably.

Further, in a direction perpendicular to the plane including the first cam shaft 403 and the second cam shaft 404 (Z-axis direction), the abutment projection plate 305*d* is positioned between the rotation shaft 312*a* of the pressure application roller 312 and the right lower front part slit 305*b* at the nip position, and the abutment projection plate 305*e* is positioned between the rotation shaft 312*a* of the pressure application roller 312 and the right lower rear part slit 305*c* at the nip position. With this, the sliding movement of the lower movable unit 300 may be performed stably.

Further, the bias force of the first spring 321 at the detached position is smaller than the bias force of the first spring 321 at the nip position, and the bias force of the second spring 322 at the detached position is smaller than the bias force of the second spring 322 at the nip position, so it is possible to reduce the strength of the regulation plate 341 receiving the bias force of the first spring at the detached position and the strength of the left and right end parts 344 and 345 of the pressure application pad holder 332 receiving the bias force at the second spring 322 at the detached position.

(Position Detection Mechanism)

Figure 25:
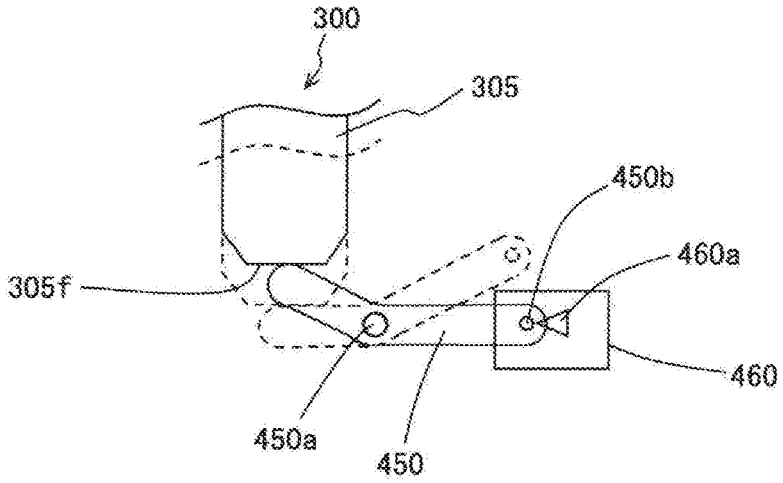
FIG. 25 is a configuration view schematically showing a position detection mechanism.

Next, the position detection mechanism of the lower movable unit 300 which slidably moves in the up and down direction with respect to an integrated upper stationary unit 200 and the base unit 400 will be described. FIG. 25 schematically illustrates the configuration of the position detection mechanism.

A position detection arm 450 which comes into contact with the engagement part 305*f* of the right side chassis 305 of the lower movable unit 300 which slidably moves in the up and down direction (see (b) of FIG. 9) is rotatably held at the base unit 400. The detection arm 450 is shaped into an L-shape and rotatably held by the base unit 400 with the bent portion as the rotation shaft 450*a*, and one end part is in contact with the engagement part 305*f* of the right side chassis 305 and the other end part is provided with a detected part 450*b* (or a part to be detected). Further, it is assumed that the position detection arm 450 yields a force to rotate in the clockwise direction in a required rotation range from self-weight.

The detector 460 is arranged in the base unit 400 and configured to detect the detected part 450*b* of the position detection arm 450 at the detection position 460*a*, and as shown by the solid line in FIG. 25, it is positioned to detect the detected part 450*b* of the position detection arm 450 when the lower movable unit 300 reaches the nip position at the uppermost position. Therefore, the detector 460 detects that the lower movable unit 300 has reached the nip position at the uppermost position and outputs the detection information to the image forming control part 600 (FIG. 26) to be described later.

(Control of Cam Drive Motor)

Figure 26:
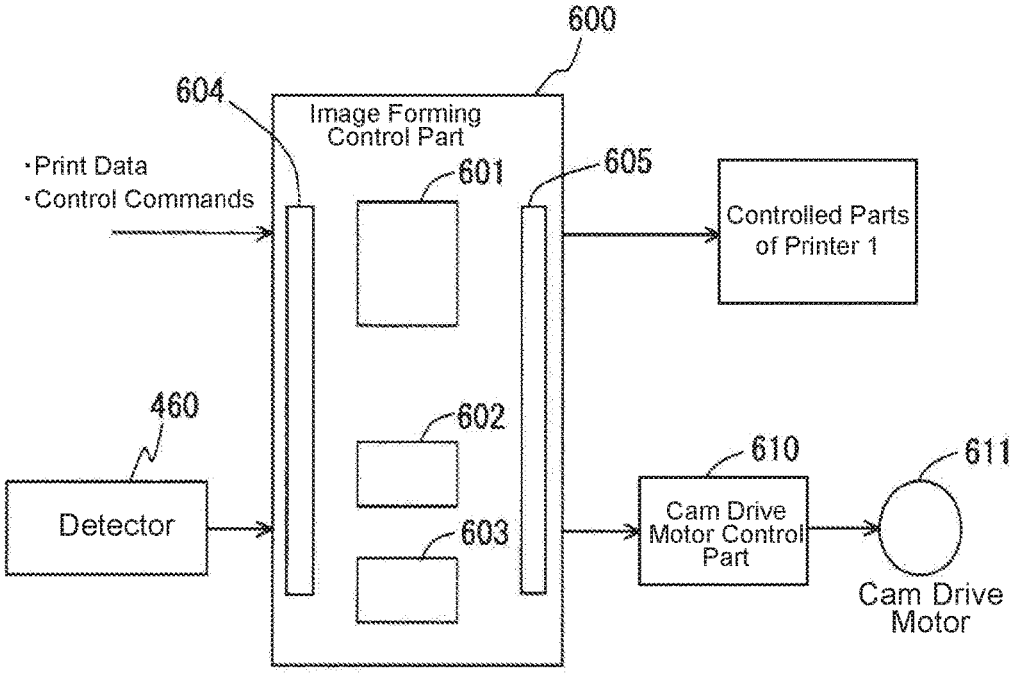
FIG. 26 is a block diagram showing a main configuration of a control system arranged inside a printer and configured to control main operations of the printer.

FIG. 26 is a block diagram showing the main configuration of a control system arranged inside the printer 1 and configured to control the main operations of the printer 1.

In the figure, the image forming control part 600 includes a processor 601, a ROM 602, a RAM 603, input/output ports 604 and 605, a counter, a timer, etc., and is configured to receive print data and control commands from a higher-level device to perform a sequential control of the printer 1 as a whole and perform the printing operation. Here, the description of these operations will be omitted.

Further, the control part 600 inputs the detection information from the detector 460 and based on the information, outputs an instruction signal to the cam drive motor control part 610 which drivingly controls the cam drive motor 611.

The cam drive motor 611 is arranged inside the print part 3 (FIG. 1) and meshes with the cam drive input gear 401 of the fuser device 37 similarly installed inside the print part 3 via an unillustrated motor drive transmission system to rotatably drive the cam drive input gear 401 in the arrow C direction (FIG. 5).

Here, the image forming control part 600, for example, at the time of carrying the recording sheet 6 accompanying the printing operation, instructs the cam drive motor control part 610 to rotatably drive the cam drive motor control part 610 to move the lower movable unit 300 of the fuser device 37 to the uppermost nip position, and instructs to stop the rotation after receiving the detection information from the detector 460 indicating that the lower movable unit 300 has reached the nip position. With this, the lower movable unit 300, for example, can be maintained at the nip position as shown in FIG. 17.

Further, for the drive transmission system from the cam drive motor 611 to the cam drive input gear 401, for example, a worm gear can be interposed so that when the cam drive motor 611 is stopped, the first and the second cam shafts 403 and 403 do not rotate from the load.

On the other hand, the image forming control part 600, for example, when the recording sheet 6 is not being carried when the printing is stopped, instructs the cam drive motor control part 610 to rotate and drive the cam drive motor 611 for a predetermined amount to move the lower movable unit 300 of the fuser device 37 to the detached position at the lowermost position. Here, the number of rotations of the cam drive motor 611 or the driving time is set in advance so that the cams 412 and 422 revolve the lower movable unit 300 for a predetermined angle of rotation from the rotation position in which the lower movable unit 300 is maintained at the nip position as shown in FIG. 20 to the rotation position in which the lower movable unit is maintained at the detached position as shown in FIG. 22. Here, the detector 460, the image forming control part 600, the cam drive motor control part 610, and the cam drive motor 611 correspond to the drive control part.

In the aforementioned configuration, the image forming control part 600 repeats the movement of positions between the nip position and the detached position of the lower movable unit 300 according to operation and stopping of the printing operation of the printer 1.

Further, in this Example, although it was described to perform printing on a recording sheet 6 in which a rolled sheet 5 is cut, it is not limited to that, and various embodiments can be used, such as printing on a rolled sheet 5 as it is.

As described above, according to the printer 1 of this Example, since the pressure application unit 310 can be moved to the nip position and the detached position with respect to the fuser unit 210 of the fuser device 37, while the recording sheet is not carried, an undesired situation in which the recording sheet 6 or the rolled sheet 5 is sandwiched by the fuser unit 210 and the pressure application unit 310 and left there can be prevented.

Further, in the description of this Example, terms such as "top", "bottom", "left", "right", "front" and "rear" are used, but these are used for convenience and they do not limit the absolute positional relationship when arranging the fuser device.

In this Example, the present invention was described by using an example in which it is applied to a secondary transfer type color printer of an electrographic system, but the present invention is not limited to that, and may be applied to a facsimile device, a copier, an MFP (Multifunction Peripheral), and furthermore, a color printer, a monochromatic printer, etc., of a primary transfer system.

What is claimed is:

1. A fuser device that fuses a developer image on a recording medium that is carried along a carrying path, comprising:

a first unit that is stable to the fuser device;

a second unit that is linearly movably arranged with respect to the first unit, the carrying path intervening between the first unit and the second unit; and a movement mechanism that linearly moves the second unit between a first position and a second position with respect to the first unit, at least one of the first unit and the second unit providing heat on the recording medium, wherein the first unit includes an endless first belt, and a fuser member that is rotatably held about a rotation shaft positioned on an inner side of the first belt, the second unit includes an endless second belt, a pressure application member that is rotatably held about another rotation shaft displaceable on an inner side of the second belt, and a first bias member that biases the pressure application member toward the fuser member, and the pressure application member, at the first position, presses the fuser member via the first belt and the second belt using the first bias member such that a nip part, where the developer image is fused on the recording medium, is formed between the pressure application member and the fuser member, and at the second position, is detached from the fuser member so that the nip part is eliminated.

2. The fuser device according to claim 1, wherein the first bias member is a compression spring, and a bias force of the first bias member at the second position is smaller than that of the first bias member at the first position.

3. The fuser device according to claim 2, wherein the second unit includes an arm that is held to rotate around a revolving shaft, and the arm rotatably holds the pressure application member about a rotation shaft that is parallel to the revolving shaft of the arm and receives the bias force by the first bias member on an opposite side from the revolving shaft via the rotation shaft.

4. The fuser device according to claim 3, the movement mechanism includes a first cam shaft and a second cam shaft that are arranged in parallel each other and rotatably held, a first cam and a second cam that are respectively fixed to the first cam shaft and a second cam shaft, and a drive transmission system that transmits a driving force to the first cam shaft and the second cam shaft so that the first cam and the second cam rotate, the second unit includes a first engagement part that is engaged with a circumferential surface of the first cam and a second engagement part that is engaged with a circumferential surface of the second cam, and a first guide groove along which the first cam shaft is guided and a second guide groove in which the second cam shaft is guided, and in a direction that is parallel to a plane including the first cam shaft and the second cam shaft and is orthogonal to the first cam shaft, the rotation shaft of the pressure application member at the first position is positioned between the first cam shaft and the second cam shaft.

5. The fuser device according to claim 3, the movement mechanism includes a first cam shaft and a second cam shaft that are arranged in parallel each other and rotatably held, a first cam and a second cam that are respectively fixed to the first cam shaft and a second cam shaft, and a drive transmission system that transmits a driving force to the first cam shaft and the second cam shaft so that the first cam and the second cam rotate, the second unit includes a first engagement part that is engaged with a circumferential surface of the first cam and a second engagement part that is engaged with a circumferential surface of the second cam, and a first guide groove along which the first cam shaft is guided and a second guide groove in which the second cam shaft is guided, and in a direction perpendicular to a plane including the first cam shaft and the second cam shaft, the first engagement part is positioned between the rotation shaft of the pressure application member at the first position and the first guide groove, and the second engagement part is positioned between the rotation shaft of the pressure application member at the first position and the second guide groove.

6. The fuser device according to claim 1, wherein the fuser member is one of a roller and a pad, and the pressure application member is one of a roller and a pad.

7. An image forming apparatus, comprising:

the fuser device according to claim 1; and an image forming part that forms a developer image;

an image transfer part that transfers the developer image to the recording medium;

a drive control part that controls a movement of the second unit, wherein the image forming part, the image transfer part and the fuser device are arranged in this order along the carrying path toward its downstream, and the drive control part moves the second unit to the second position from the first position when the image forming part does not form the developer image.

8. A fuser device that fuses a developer image on a recording medium that is carried along a carrying path, comprising:

a first unit that is stable to the fuser device;

a second unit that is movably arranged with respect to the first unit, the carrying path intervening between the first unit and the second unit; and a movement mechanism that moves the second unit between a first position and a second position with respect to the first unit, at least one of the first unit and the second unit providing heat on the recording medium, wherein the first unit includes an endless first belt, and a fuser member that is rotatably held about a rotation shaft positioned on an inner side of the first belt, the second unit includes an endless second belt, a pressure application member that is rotatably held about another rotation shaft displaceable on an inner side of the second belt, and a first bias member that biases the pressure application member toward the fuser member, the pressure application member, at the first position, presses the fuser member via the first belt and the second belt using the first bias member such that a nip part, where the developer image is fused on the recording medium, is formed between the pressure application member and the fuser member, and at the second position, is detached from the fuser member so that the nip part is eliminated, the movement mechanism includes a first cam shaft and a second cam shaft that are arranged in parallel each other and rotatably held, a first cam and a second cam that are respectively fixed to the first cam shaft and a second cam shaft, and a drive transmission system that transmits a driving force to the first cam shaft and the second cam shaft so that the first cam and the second cam rotate, and the second unit includes a first engagement part that is engaged with a circumferential surface of the first cam and a second engagement part that is engaged with a circumferential surface of the second cam, and a first guide groove along which the first cam shaft is guided and a second guide groove in which the second cam shaft is guided.

9. A fuser device that fuses a developer image on a recording medium that is carried along a carrying path, comprising:

a first unit that is stable to the fuser device;

a second unit that is movably arranged with respect to the first unit, the carrying path intervening between the first unit and the second unit, and a movement mechanism that moves the second unit between a first position and a second position with respect to the first unit, at least one of the first unit and the second unit providing heat on the recording medium, wherein the first unit includes an endless first belt, and a fuser member that is rotatably held about a rotation shaft positioned on an inner side of the first belt, the second unit includes an endless second belt, a pressure application member that is rotatably held about another rotation shaft displaceable on an inner side of the second belt, and a first bias member that biases the pressure application member toward the fuser member, the pressure application member, at the first position, presses the fuser member via the first belt and the second belt using the first bias member such that a nip part, where the developer image is fused on the recording medium, is formed between the pressure application member and the fuser member, and at the second position, is detached from the fuser member so that the nip part is eliminated, the first unit includes a first pad fixed to an inner side of the first belt, the second unit includes a second pad that is movable on an inner side of the second belt, and a second bias member that biases the second pad toward the first pad, and the second pad, at the first position, is contacted and pressed to the first pad via the first belt and the second belt using the second bias member and, at the second position, is detached from the first pad.

10. The fuser device according to claim 7, wherein the second bias member is a compression spring, and a bias force of the second bias member at the second position is smaller than that of the second bias member at the first position.

11. The fuser device according to claim 10, wherein the second unit further includes a supporting member that supports the pressure application member such that the pressure application member moves toward the first unit, and a regulation member that regulates a positional change of the supporting member in a direction toward the first unit, the first bias member is arranged to bias the support member toward the regulation member, when the second unit is at the first position, the supporting member is detached from the regulation member, and the pressure application member presses the fuser member via the first belt and the second belt using a bias force by the first bias member, and when the second unit is at the second position, the supporting member is detached from the fuser member, and the supporting member is in contact with the regulation member using the bias force by the first bias member.

12. A fuser device that fuses a developer image on a recording medium that is carried along a carrying path, comprising:

a first unit that is stable to the fuser device;

a second unit that is movably arranged with respect to the first unit, the carrying path intervening between the first unit and the second unit, and a movement mechanism that moves the second unit between a first position and a second position with respect to the first unit, at least one of the first unit and the second unit providing heat on the recording medium, wherein the first unit includes an endless first belt, and a fuser member that is rotatably held about a rotation shaft positioned on an inner side of the first belt, the second unit includes an endless second belt, a pressure application member that is rotatably held about another rotation shaft displaceable on an inner side of the second belt, and a first bias member that biases the pressure application member toward the fuser member, the pressure application member, at the first position, presses the fuser member via the first belt and the second belt using the first bias member such that a nip part, where the developer image is fused on the recording medium, is formed between the pressure application member and the fuser member, and at the second position, is detached from the fuser member so that the nip part is eliminated, the second unit further includes a supporting member that supports the pressure application member such that the pressure application member moves toward the first unit, and a regulation member that regulates a positional change of the supporting member in a direction toward the first unit, the first bias member is arranged to bias the support member toward the regulation member, when the second unit is at the first position, the supporting member is detached from the regulation member, and the pressure application member presses the fuser member via the first belt and the second belt using a bias force by the first bias member, and when the second unit is at the second position, the supporting member is detached from the fuser member, and the supporting member is in contact with the regulation member using the bias force by the first bias member.

* * * * *